US006876830B2

(12) United States Patent
Ohgita et al.

(10) Patent No.: US 6,876,830 B2
(45) Date of Patent: Apr. 5, 2005

(54) IMAGE FORMING SYSTEM HAVING A SPACE FOR UNJAMMING

(75) Inventors: Toshiki Ohgita, Nara (JP); Shigeki Hayashi, Nara (JP); Jinichi Nagata, Osaka (JP); Kiyoshi Tokishige, Kyoto (JP); Naofumi Okada, Tenri (JP); Masaki Saka, Nabari (JP); Toyoaki Nanba, Higashiosaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 38 days.

(21) Appl. No.: 10/646,781

(22) Filed: Aug. 25, 2003

(65) Prior Publication Data

US 2004/0047652 A1 Mar. 11, 2004

(30) Foreign Application Priority Data

Sep. 5, 2002 (JP) ..... 2002-259824
Sep. 5, 2002 (JP) ..... 2002-259844

(51) Int. Cl.[7] ..... G03G 21/00
(52) U.S. Cl. ..... 399/124; 399/107; 399/407
(58) Field of Search ..... 399/21, 107, 124–125, 399/402–410

(56) References Cited

U.S. PATENT DOCUMENTS 5,995,773 A * 11/1999 Awano ..... 399/124

FOREIGN PATENT DOCUMENTS

JP 63287863 A * 11/1988 ..... G03G/15/00
JP 4-86836 A 3/1992
JP 6-286922 A 10/1994

* cited by examiner

*Primary Examiner*—Arthur T. Grimley
*Assistant Examiner*—Ryan Gleitz
(74) *Attorney, Agent, or Firm*—Birch, Stewart, Kolasch & Birch, LLP

(57) ABSTRACT

In an image forming system, an image forming device and a post-treatment device are provided so as to keep a distance L therebetween, by a positioning member and a transfer relaying device, and the image forming device is connected with the post-treatment device by the transfer relaying device. With this arrangement, a space surrounded by the image forming device, post-treatment device, positioning member, and transfer relaying device is made. On this account, it is possible to provide an image forming system in which an image forming device is coupled with a peripheral unit, which does not require cumbersome operations to make a space between the image forming device and the peripheral unit, on the occasion of carrying out unjamming treatment between the image forming device and the peripheral unit.

16 Claims, 12 Drawing Sheets

IMAGE FORMING SYSTEM HAVING A SPACE FOR UNJAMMING

This Nonprovisional application claims priority under 35 U.S.C. §119(a) on Patent Application Nos. 2002-259824 and 2002-259844 filed in Japan on Sep. 5, 2002, the entire contents of which are hereby incorporated by reference.

FIELD OF THE INVENTION

The present invention relates to an image forming system in which a peripheral unit is coupled with an image forming device.

BACKGROUND OF THE INVENTION

There have recently been image forming systems in which an image forming device is coupled with a peripheral unit which is suitable for environment or requirements of the user.

As an example of such image forming systems, there is an image forming system in which an image forming device is coupled with a switchback machine as a peripheral unit. The image forming system operates in the following manner: first, the image forming device discharges a recording material (sheet), an image having been formed on one of two sides of the sheet, to the switchback machine. Then after being reversed by the switchback machine, the sheet is supplied to the image forming device. Since images can be formed on both sides of a sheet, the image forming system can realize resource saving.

As another example, there is an image forming system in which an image forming device is coupled with a post-treatment device as a peripheral unit. This image forming system operates in the following manner: a sheet on which an image has been formed by the image forming device is sent to the post-treatment device. Then in the post-treatment device, the sheet is subjected to processes such as punch hole forming, stapling, and sorting. This image forming system makes it possible to improve the operating efficiency.

In this manner, in image forming systems in which an image forming device is coupled with a peripheral unit, not only the type of the peripheral unit but also the type of the image forming device can be arbitrarily determined in accordance with the intended use such as copying and printing. Thus, since it is possible to arbitrarily select and combine an image forming device and a peripheral unit, the final state of an image can be arbitrarily selected or arranged by the user, and hence these image forming systems excel in extensibility.

Incidentally, in the above-mentioned image forming systems, a sheet may jam in a sheet carrying system of the image forming device or the peripheral unit. When this occurs, the user has to perform operations to recover the image forming system, such as removing the jammed sheet.

In this case, when, in order to perform the unjamming treatment, a space between the image forming device and the peripheral unit has to be made by, for instance, pulling a predetermined unit of the image forming device towards the peripheral unit, it is necessary to carry out a lot of operations such as removing or repositioning the peripheral unit coupled with the image forming device, before performing the unjamming treatment. Further, since these operations require spaces for the operation to remove the peripheral unit and for temporarily placing the removed peripheral unit, it is often required to make these spaces by laboriously removing objects occupying the spaces.

Japanese Laid-Open Patent Application No. 4-86836/1992 (Tokukaihei 4-86836; published on Mar. 19, 1992) discloses an image forming device arranged such that the foreside of the main body of the image forming device has an opening, and inside the opening, an openable unit with members such as a carrying member is provided. In this image forming device, the user can put his/her hand into the opening and remove the jammed sheet. Since the unjamming treatment can be performed through the opening without making a space between the image forming device and the peripheral unit, it is unnecessary to remove or reposition the peripheral unit to treat the paper jam, even if the peripheral unit remains to be coupled with the image forming device.

Also, Japanese Laid-Open Patent Application No. 6-286922/1994 (Tokukaihei 6-286922; published on Oct. 11, 1994) discloses an image forming system in which a peripheral unit coupled with an image forming device is composed of a plurality of subunits. In this image forming system, the subunits can be moved on a support on the floor so as to be away from the image forming device, and hence spaces to which the subunits are moved are provided in advance. When paper jam occurs around the connection between the image forming device and the subunit or inside the subunit, the user uncouples a corresponding subunit from the image forming system and moves the subunit on the support, so as to make a space around the point of the jam. Then using this space, the user removes the jammed sheet. In this image forming system, a space for performing the unjamming treatment, which is made by uncoupling the image forming device and the peripheral unit, is provided on the support in advance.

However, according to the image forming device of Japanese Laid-Open Patent Application No. 4-86836/1992, since the space for removing the jammed sheet is made inside the image forming device, the space to be made is not sufficiently large so that the removal of the sheet is still difficult. Moreover, this space is noncontributory to remove the paper jam inside the peripheral unit.

Even if the invention of Japanese Laid-Open Patent Application No. 6-286922/1994 is incorporated into the foregoing invention in order to perform the unjamming treatment by uncoupling the image forming device and the peripheral unit and making a space sufficient for the treatment, when it is arranged so that a part of the image forming system is pulled off for performing the unjamming treatment, it is still necessary for the user to detach and move a corresponding subunit of the peripheral unit before pulling off the part of the image forming system, and hence laborious operations are still required.

Further, even if the space on the support, to which the peripheral unit is to be moved, is provided in advance, since the space is provided beside the image forming system, goods are often placed on the support on the floor and a part of another device easily enters the space. Thus, the space to which the peripheral unit is to be moved cannot always readily function. On this account, in some cases, it is still necessary to laboriously remove the obstacles from the space, on the occasion of the paper jam.

In this manner, conventional image forming systems have had such a problem that it is cumbersome to carry out the operation of uncoupling an image forming device and a peripheral unit, on the occasion of performing unjamming treatment between the image forming device and the peripheral unit.

SUMMARY OF THE INVENTION

The objective of the present invention is to provide an image forming system in which an image forming device is coupled with a peripheral unit, which does not require cumbersome operations to make a space between the image forming device and the peripheral unit, on the occasion of carrying out unjamming treatment between the image forming device and the peripheral unit.

To achieve this objective, the image forming system in accordance with the present invention, which includes an image forming device which forms an image on a recording material and a peripheral unit which is provided alongside the image forming device so as to be coupled with the image forming device, the peripheral unit subjecting the recording material, to which image forming is carried out by the image forming device, to a predetermined treatment, is characterized by comprising: positioning means which determines positioning of the image forming device and the peripheral unit; and a transfer relaying device which relays the recording material supplied from the image forming device to the peripheral unit, the positioning means determining the positioning so as to cause a distance between the image forming device and the peripheral unit to be sufficient for a space provided for unjamming treatment of the recording material carried out between the image forming device and the peripheral unit, and the transfer relaying device connecting the image forming device and the peripheral unit so as to keep the space intact, except a part of the space occupied by the transfer relaying device.

According to this arrangement, a space for unjamming treatment of the recording material is provided between the image forming device and the peripheral unit in advance, thanks to such an arrangement that the positioning of the image forming device and the peripheral unit is determined by the positioning means, and the image forming device and the peripheral unit are connected via the transfer relaying device. Thus, when the recording material is jammed in a recording material carrying system either in the image forming device or in the peripheral unit coupled with the image forming device so that unjamming treatment is performed between the image forming device and the peripheral unit, it is possible to easily remove the jammed recording material, using the above-mentioned space. On this account, it is unnecessary to remove or reposition the peripheral unit to make the above-mentioned space for the unjamming treatment.

As a result, it is possible to obtain an image forming system in which an image forming device is coupled with a peripheral unit, which does not require cumbersome operations to make a space between the image forming device and the peripheral unit, on the occasion of carrying out unjamming treatment between the image forming device and the peripheral unit.

To achieve the foregoing objective, the image forming system of the present invention, which includes an image forming device which forms an image on a recording material and a peripheral unit which is provided alongside the image forming device so as to be coupled with the image forming device, the peripheral unit subjecting the recording material, to which image forming is carried out by the image forming device, to a predetermined treatment, is characterized by comprising: a transfer relaying device which acts as first positioning means which determines positioning of the image forming device and the peripheral unit in an upper part of the image forming system, and relays the recording material supplied from the image forming device to the peripheral unit; and second positioning means which determines positioning of the image forming device and the peripheral unit in a lower part of the image forming system, the first and second positioning means being provided so as to make a space therebetween, the space being for unjamming treatment of the recording material carried out between the image forming device and the peripheral unit, and the first and second positioning means causing a distance between the image forming device and the peripheral unit to be sufficient for the space, and the transfer relaying device being a plate-shaped device in which a relaying path is horizontally provided, a bottom-surface section provided below the relaying path being movable towards the space.

According to this arrangement, a space for unjamming treatment of the recording material is provided between the image forming device and the peripheral unit in advance, thanks to such an arrangement that the positioning of the image forming device and the peripheral unit is determined by the first positioning means (i.e. transfer relaying device) and the second positioning means, and the image forming device and the peripheral unit are connected via the transfer relaying device. Thus, when the recording material is jammed in a recording material carrying system either in the image forming device or in the peripheral unit coupled with the image forming device so that unjamming treatment is performed between the image forming device and the peripheral unit, it is possible to easily remove the jammed recording material, using the above-mentioned space. On this account, it is unnecessary to remove or reposition the peripheral unit to make the above-mentioned space for the unjamming treatment.

As a result, it is possible to obtain an image forming system in which an image forming device is coupled with a peripheral unit, which does not require cumbersome operations to make a space between the image forming device and the peripheral unit, on the occasion of carrying out unjamming treatment between the image forming device and the peripheral unit.

Further, when the unjamming treatment is performed using the above-described space, a predetermined unit for unjamming treatment, the unit being provided either in the image forming device or in the peripheral unit, is pulled off to the space so that a carrying path in which the jam occurs is released. On this occasion, since the bottom surface of the transfer relaying device can be opened towards the space, i.e. can be opened downwards, it is possible to easily perform the unjamming treatment by releasing the transfer relaying path, even if the jammed sheet is inside the transfer relaying path.

Moreover, even if an object is placed on the top-surface of a top-surface section of the transfer relaying device, it is unnecessary to cause the top-surface section to rotate on the occasion of unjamming treatment so that the unjamming treatment can be performed without removing the object on the top surface of the top-surface section.

For a fuller understanding of the nature and advantages of the invention, reference should be made to the ensuing detailed description taken in conjunction with the accompanying drawings.

DESCRIPTION OF THE EMBODIMENTS

First Embodiment

The following will describe an embodiment of an image forming system of the present invention, with reference to FIGS. 1–6.

Figure 1:
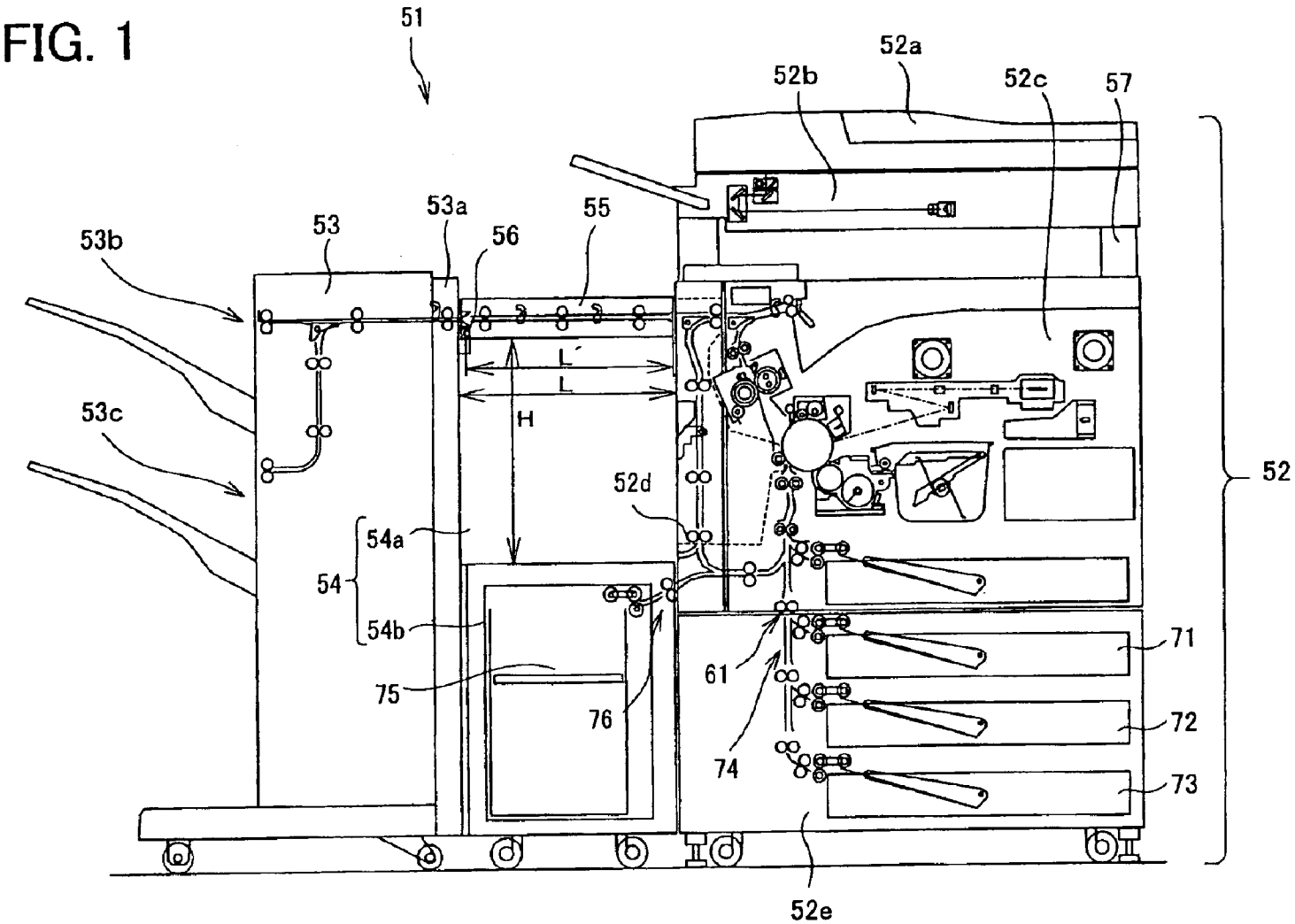
FIG. 1 is a cross section, illustrating an image forming system of an embodiment of the present invention.

FIG. 1 illustrates an image forming system 51 of the present embodiment. This image forming system 51 includes an image forming device 52, a post-treatment device 53, a positioning member 54, and a transfer relaying device 55.

As a printer or photocopier, the image forming device 52 is a device for forming an image on a sheet (recording material), and includes an automatic document carrying device 52*a*, an image scanning device 52*b*, an image recording device 52*c*, a recording material re-feeding/carrying device 52*d*, and a recording material feeding device 52*e*.

The automatic document carrying device 52*a* carries a document and causes the document to be scanned by the image scanning device 52*b*, and the image scanning device 52*b* scans a document which is carried by the automatic document carrying device 52*a* or placed on a document supporter. The image recording device 52*c* records image data of the document having been scanned by the image scanning device 52*b* to a recording material supplied via an internal recording material feeding section and the recording material feeding device 52*e*, as an image. The recording material feeding device 52*e* includes a multi-staged recording material feeding tray which is an optional device. The recording material re-feeding/carrying device 52*d* re-feeds a sheet, an image having been formed on one of the surfaces of the sheet by the image recording device 52*c*, to the image recording device 52*c*, in order to form images on the remaining side of the sheet.

The positioning member (positioning means) 54 is a member for determining the positioning of the image forming device 52 and the post-treatment device 53, thereby including an upper connecting member 54*a* and a recording material feeding device 54*b*, which are for fixing the image forming device 52 and the post-treatment device 53 when the image forming system 51 is in operation. The upper connecting member (first positioning member) 54*a* connects the image forming device 52 with the post-treatment device 53 on the side opposite to the side of a control panel of the image forming system 51, i.e. on the back side of the image forming system 51. The recording material feeding device (second positioning member) 54*b* stores a large amount of sheets, thereby feeding the sheets to the image recording device 52*c*. The recording material feeding device 54*b* connects the image forming device 52 with the post-treatment device 53, and is a lower connecting member with respect to the upper connecting member 54*a*. The transfer relaying device 55 connects the image forming device 52 with the post treatment device 53, which are both positioned by the positioning member 54, and the transfer relaying device 55 relays the transfer of the sheets from the image forming device 52 to the post-treatment device 53. The post-treatment device (peripheral unit) 53 is provided beside the image forming device 52, and the positioning member 54 and the transfer relaying device 55 are provided therebetween so as to connect the post-treatment device 53 with the image forming device 52. Receiving a sheet on which an image has been formed by the image forming device 52 via the transfer relaying device 55, the post-treatment device 53 subjects the sheet to predetermined post-treatments such as punch hole forming, stapling, and sorting.

Next, components of the image forming system 51 will be described.

The image scanning device 52*b* is provided with an image scanning device support 57 above the image recording device 52*c* and the recording material re-feeding/carrying device 52*d*, and is supported by the image scanning device support 57. The image scanning device 52*b* subjects an image on a document on a transparent document supporter (not illustrated) to exposure and scanning so that the image is focused on a photoelectric conversion element, and then the image of the document is converted to an electric signal and outputted as image data. Also, in the process of carrying a document along an automatic document carrying path by the automatic document carrying device 52*a*, the image scanning device 52*b* scans an image of the document from both the upper and lower parts of the document.

From the lower part of the document, a mobile scanning optical system which usually moves on and scans the bottom surface of the document supporter leads an optical image to a CCD which is the photoelectric conversion element so as to scan the image of the document, in the state that the mobile scanning optical system is at a halt at a predetermined position of the document carrying path. When both sides of the document are simultaneously scanned, a contact image sensor (CIS), which is integrally constituted by members such as a light source for subjecting the top surface of the document to exposure, an optical lens leading an optical image to a photoelectric conversion element, and the photoelectric conversion element which converts the optical image into image data, is attached to the automatic document carrying device 52*a* in order to simultaneously scan the both sides of the document.

With this arrangement, when a duplex scanning mode is set, documents stored in a feeding section of the automatic document carrying device 52*a* are serially carried, and the images thereon are scanned almost simultaneously.

The image scanning device 52*b* has an automatic scan mode and a manual scan mode. In the automatic scan mode, documents as separated sheets are automatically fed by the automatic document carrying device 52*a*, and exposed and scanned one-by-one in a sequential manner so that images on the documents are read. In the manual scan mode, book-type documents or sheet-type documents which cannot be automatically fed by the automatic document carrying device 52*a* are manually set and the images thereof are read.

Figure 2:
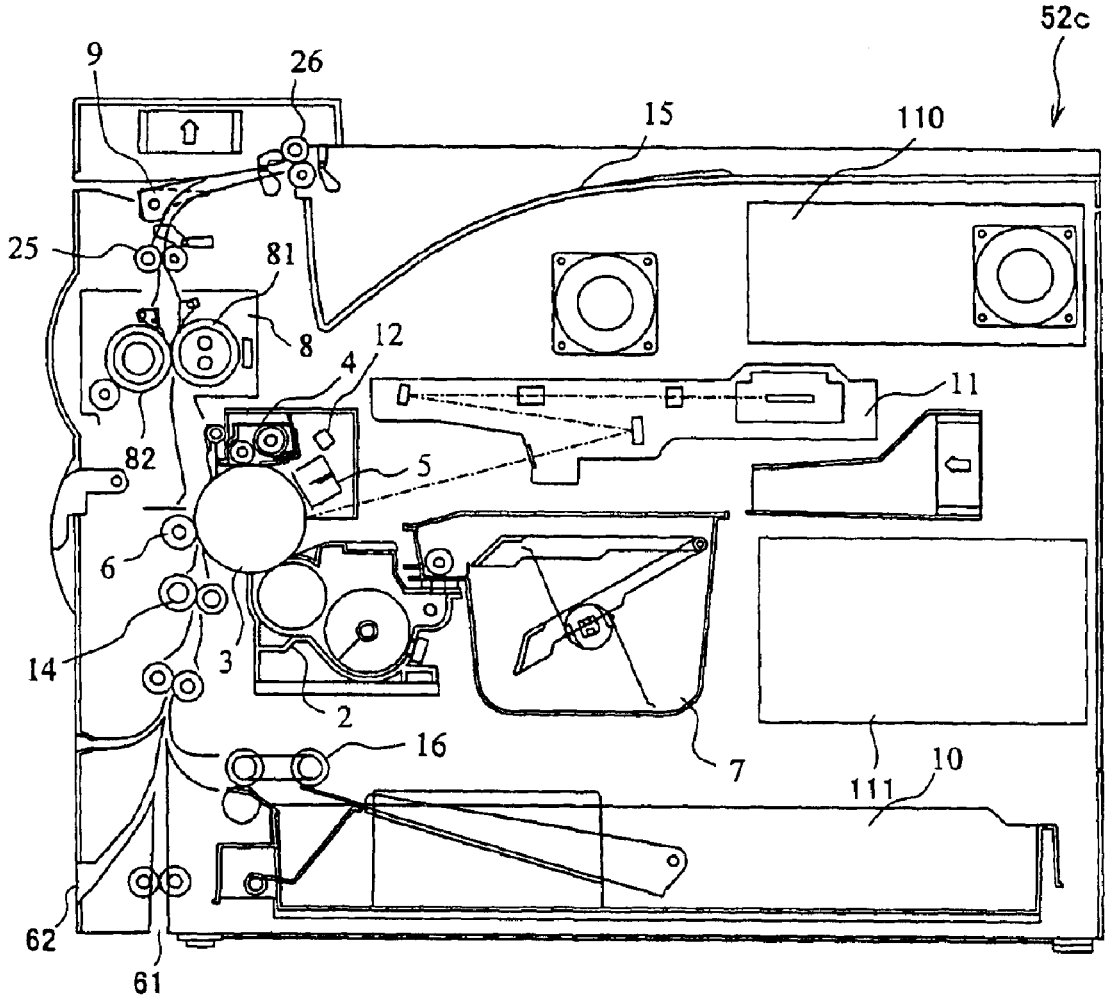
FIG. 2 is a cross section, illustrating an image recording device of the image forming system of FIG. 1.

Now, FIG. 2 illustrates a detailed cross section of the image recording device 52*c*. As images, the image recording device 52*c* records and outputs data scanned by the image scanning device 52*b* and images supplied from devices (e.g. image processing devices such as a personal computer) externally connected to the image recording device 52*c*.

The image recording device 52*c* is arranged in such a manner that, process units corresponding to respective functions of the image forming process are provided around a photoconductive drum 3, and these members constitutes an image forming section. Around the photoconductive drum 3, members such as a charging means 5, an optical scanning unit 11, a developing unit 2, a transfer means 6, a cleaning unit 4, and a diselectrifying lamp 12 are sequentially provided.

The charging means 5 evenly charges the surface of the photoconductive drum 3. The optical scanning unit 11 scans an optical image on the evenly-charged photoconductive drum 3 so as to write an electrostatic latent image onto the photoconductive drum 3. The developing unit 2 visualizes the electrostatic latent image written by the optical scanning unit 11, using a developing agent supplied from a developing agent supply container 7. The transfer means 6 transfers the image visualized on the photoconductive drum 3 to the surface of a recording material. The cleaning unit 4 removes the residual developing agent on the photoconductive drum 3 and allows a new image to be written onto the photoconductive drum 3. The diselectrifying lamp 12 removes the electrical charge on the surface of the photoconductive drum 3.

In the lower part of the image recording device 52*c*, a feeding tray 10 is provided therein.

The feeding tray 10 is a recording material storing tray which stores sheets. The sheets stored in the feeding tray 10 are separated into each individual sheet by a pickup roller 16 and carried to a resist roller 14, the resist roller 14 monitors the synchronism between each of the sheet and the image formed on the photoconductive drum 3, and the sheets are serially supplied to a space between the transfer means 6 and the photoconductive drum 3. Then an image recorded and reproduced on the photoconductive drum 3 is transferred to the sheet. By the way, supply of sheets to the feeding tray 10 is carried out by pulling the feeding tray off towards the front face (the side of a control panel) of the image recording device 52*c*.

On the bottom surface of the image recording device 52*c*, a sheet receiving slit 61 is provided in order to receive sheets from the recording material feeding device 52*e* and serially supply the sheets to the image forming section. In the lower part of the side face of the image recording device 52*c*, an expanded recording material receiving section 62 for receiving the sheets supplied from the recording material feeding device 54*b* via the recording material re-feeding/carrying device 52*d* and serially supplying the sheets towards the image forming section is provided.

In the upper part of the image recording device 52*c*, a fixing device 8 is provided. This fixing device 8 serially receives the sheets on which images have been transferred, and fixes the images on the respective sheets by heat and pressure, using a fixing roller 81 and a pressure roller 82. With this arrangement, the images are recorded on the respective sheets.

The sheets on which images have been recorded are carried further upward by a carrying roller 25, and pass through a switching gate 9. When a stacker tray 15 provided outside of the image recording device 52*c* is selected, the sheets are discharged to the stacker tray 15 by a reversing roller 26. When duplex image forming or post-treatment is planned, the reversing roller 26 carries the sheet towards the stacker tray 15. In this case, the sheet is not fully discharged to the stacker tray 15, and the reversing roller 26 counter-rotates with the sheet being pinched. Then the sheet is carried in the opposite direction, towards the recording material re-feeding/carrying device 52*d* and the post-treatment device 53 which are selectively attached.

On this occasion, the switching gate 9 is switched from the state indicated by full lines to the state indicated by dotted lines in FIG. 2. When the duplex image forming is carried out, the recording material re-feeding/carrying device 52*d* feeds the sheets, which has been carried reversely, to the image recording device 52*c* again. When the post-treatment is performed by the post-treatment device 53, the recording material re-feeding device 52*d* switches the switching gate therein, and carries the sheets to the post-treatment device 53 via the transfer relaying device 55.

Above and below the optical scanning unit 11, members such as: a control section 110 which houses members such a circuit substrate for controlling the image forming process and an interface substrate for receiving image data from external devices; and a power source 11 for supplying power to the above-mentioned image forming process units.

As FIG. 1 illustrates, the recording material feeding device 52*e* includes recording material feeding sections 71, 72, and 73 and a recording material discharging section 74. The recording material feeding sections 71–73 store sheets. The recording material feeding device 52*e* selectively operates one of the recording material feeding sections 71–73 storing the sheet(s) selected by the user, and feeds the sheet(s) towards the recording material discharging section 74 in a separated manner. The recording material feeding device 52*e* also acts as a desk on which the image recording device 52*c* is provided, and the recording material feeding device 52*e* is selectively connectable to the image recording device 52*c*.

When the sheet is supplied by the recording material feeding device 52*e*, the sheet is passed to the sheet receiving slit 61 provided in the lower part of the image recording device 52*c*, and then the sheet is supplied to the image forming section. To supply sheets to the recording material feeding sections 71–73 or to replace the sheets stored in the recording material feeding sections 71–73, the sections 71–73 are pulled off towards the front side of the main body of the recording material feeding device 52*e*.

Although three recording material feeding sections 71–73 are provided in the recording material feeding device 52*e* of the present embodiment, the recording material feeding device 52*e* may be provided at least one recording material feeding section and at least one recording material discharging section.

Figure 3:
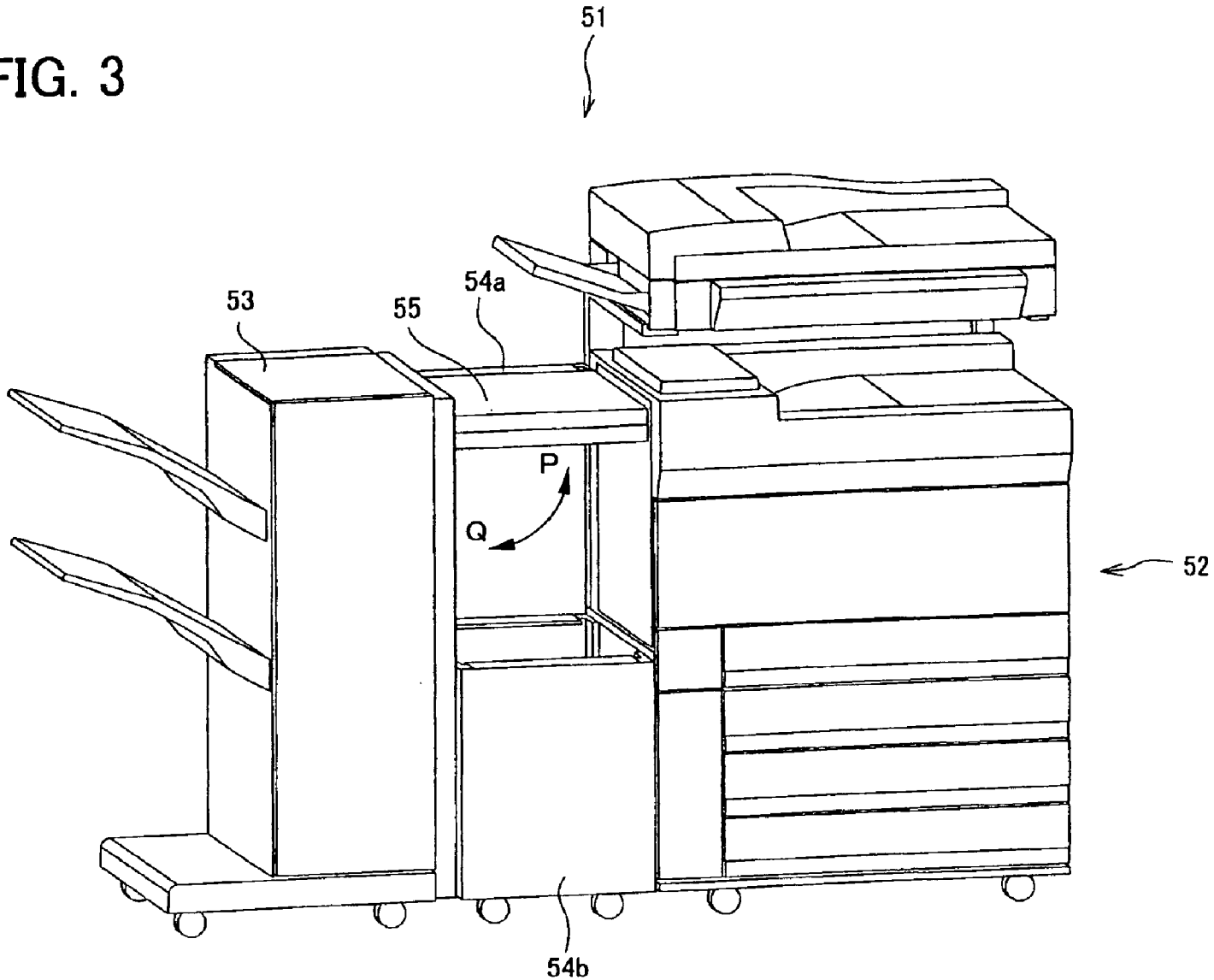
FIG. 3 is an oblique outline view, showing the operation of a transfer relaying device on the occasion of unjamming treatment of the image forming system of FIG. 1.

As illustrated in FIG. 3, the upper connecting member 54*a* of the positioning member 54 is a back-face plate or back-face stay which connects the image forming device 52 with the postOtreatment device 53 on the side opposite to the side of the control panel of the image forming system 51. One end of the upper connecting member 54*a* in the horizontal direction is fixed to the image forming device 52, while the other end thereof is fixed to the post-treatment device 53. The upper connecting member 54*a* is provided above the recording material feeding device 54*b* and on the back side of the image forming system 51, but not provided on the side of the control panel of the image forming system 54, i.e. on the front side of the image forming system 54.

Further, as FIG. 1 illustrates, the recording material feeding device 54*b* of the positioning member 54 is provided so as to fill the lower part of the space between the image forming device 52 and the postOtreatment device 53, and includes a recording material feeding section 75. The recording material feeding section 75 stores sheets, and when performing sheet supply, the recording material feeding section 75 feeds the sheets stored therein to a recording material discharging section 76 provided on the upper part of the right side of the recording material feeding device 64*b*, in a separated manner. The recording material feeding device 54*b* can store a great amount of sheets, which is greater than the amount of sheets stored in the recording material feeding sections 71–73 of the image recording device 52*c*. The bottom surface of the recording material feeding device 54*b* is flush with the bottom surface of the image forming device 52 and the bottom surface of the post-treatment device 53. In contrast, the top surface of the recording material feeding device 54*b* is kept low in order to allow predetermined units above the recording material feeding device 54*b* to be pulled from the image forming device 52 towards the post-treatment device 53, on the occasion of the unjamming treatment.

When the sheet is supplied by the recording material feeding device 54*b*, the sheet is passed to the expanded recording material receiving section 62 (cf. FIG. 2) provided in the lower part of the left side of the image recording device 52*c*, and then supplied to the image forming section.

As described above, the recording material feeding device 54*b* acts as a second positioning member and a lower connecting member, and determines where the image forming device 52 and the post-treatment device 53 are provided. The recording material feeding device 54*b* is provided between the image forming device 52 and the post-treatment device 53 and fixed to these devices, so that the image forming device 52 is connected to the post-treatment device 53 via the recording material feeding device 54*b*. As such a lower connecting member, it is possible to adopt a member in which a front lower connecting member provided on the front side of the image forming system 51 and a back lower connecting member provided on the back side thereof are individually provided, a member in which the front lower connecting member is integrated with the back lower connecting member, and a member composed of members such as the front lower connecting member, the back lower connecting member, and a stay connecting these connecting members.

Connecting the image forming device 52 with the post-treatment device 53 by means of the upper connecting member 54*a* and the recording material feeding device 54*b*, the positioning member 54 causes the image forming device 52 and the post-treatment device 53 to keep a horizontal distance L (cf. FIG. 1 ) therebetween, to provide a space for unjamming treatment of the recording material, performed between these two members. In other words, the positioning member 54 determines the positions of the image forming device 52 and the post-treatment device 53 so as to cause these two members to keep the distance L which is necessary to draw the predetermined units in order to allow the unjamming treatment.

The upper connecting member 54*a* may be integrated with the lower connecting member, or the upper connecting member 54*a* and the lower connecting member may be separately provided. When these members are separately provided, as the lower connecting member, it is possible to adopt a unit for performing a system-related operation, such as the recording material feeding device 54*b* of the present embodiment.

As FIG. 1 illustrates, the transfer relaying device 55 is a horizontally-provided and plate-shaped device which connects the top part of the recording material re-feeding/carrying device 52*d* with the top part of the post-treatment device 53. In this state, the transfer relaying device 55 receives the sheet, on which the image forming is finished, from the recording material re-feeding/carrying device 52*d*, and supplies the sheet to the post-treatment device 53.

Also, the transfer relaying device 55 is provided so as to freely rotate around a rotation axis 56 which is in touch with components such as the surface of the post-treatment device 53, the surface facing the image forming device 52, and the upper connecting member 54*a*. The rotation axis 56 is provided along the direction of connecting the front side and back side of the image forming system 51, and as in FIG. 1, a horizontal distance from the junction of the transfer relaying device 55 and the recording material re-feeding/carrying device 52*d* to the rotation axis 56 is kept at a length L'. When the connection between the transfer relaying device 55 and the recording material re-feeding/carrying device 52*d* is released so that the carrying path is detached from the image forming device 52, the transfer relaying device 55 can rotate downward for 90° around the rotation axis 56, until being vertical. Since L'<L, the surface of the transfer relaying device 55 after being rotated is substantially parallel to the side face of the post-treatment device 53.

Also, the transfer relaying device 55 is provided above the top surface of the recording material feeding device 54*b*, and the distance between these devices is kept at a length H as in FIG. 1. Thus, the connection between the transfer relaying device 55 and the recording material re-feeding/carrying device 52*d* is done in consideration of keeping the space for unjamming treatment intact, the space having the horizontal distance L' thanks to the positioning member 54. On this account, the space for sufficiently performing unjamming treatment remains between the image forming device 52 and the post-treatment device 53, even if the transfer relaying device 55 is provided. Hence, even if the remaining space is not sufficient for unjamming treatment when the transfer relaying device 55 is connected as above, it is possible to enlarge the space so as to suffice for the unjamming treatment, by appropriately moving the transfer relaying device 55 between the image forming device 52 and the post-treatment device 53. To allow the foregoing rotation, it is determined that H>L. In this manner, being surrounded by the image forming device 52, the post-treatment device 53, the recording material feeding device 54*b*, and the transfer relaying device 55, the space whose opening has the size of H×L is formed in the image forming system 51 as FIG. 1 illustrates.

The post-treatment device 53 is coupled with the image forming device 52, and according to FIG. 1, the post-treatment device 53 is provided on the left-hand side of the image forming system 51. The post-treatment device 53 performs post-treatments such as punch hole forming, stapling, and sorting to the sheet having been carried thereto. Further, the post-treatment device 53 includes a receiving/carrying section 53*a*, a first recording material discharging section 53*b*, and a second recording material discharging section 53*c*. The receiving/carrying section 53*a*, which is connected to the transfer relaying device 55, receives the sheets having been carried by the transfer relaying device 55, and supplies the received sheets to the foregoing section for the post-treatment. From the first recording material discharging section 53*b*, the sheets which are received by the receiving/carrying section 53*a* and to which no modification is performed are discharged to the outside, when no post-treatment is performed to the sheets. From the second recording material discharging section 53*c*, the sheets having been subjected to the post-treatment is discharged. In the post-treatment device 53, the user can select either the first recording material discharging section 53*b* or the second recording material discharging section 53*c*, from which the sheet on which an image is formed is discharged.

Despite not illustrated, as the post-treatment device 53, it is possible to adopt various post-treatment devices such as: a post-treatment device to which a post-treatment means for stapling a predetermined number of sheets is attached; a post-treatment device to which a post-treatment means for folding, for instance, B4 or A3-sized sheets is attached; a post-treatment device to which a post-treatment means for forming punch holes for filing is attached; and a post-treatment device to which a post-treatment means including a recording material discharging section with several to several tens of bins for sorting is attached.

The components of the image forming system 51 have been described in detail as above. As already illustrated, the space surrounded by the image forming device 52, the post-treatment device 53, the recording material feeding device 54*b*, and the transfer relaying device 55 is provided in advance. The horizontal length L of this space is arranged to be sufficient for performing unjamming treatment between the image forming device 52 and the post-treatment device 53. Thus, when a sheet is jammed at a recording material carrying system of the image forming device 52 or the post-treatment device 53 so that unjamming treatment is required between the image forming device 52 and the post-treatment device 53, it is possible to easily remove the jammed sheet from the above-mentioned space. Since this space is provided at the center of the image forming system 51 in the horizontal direction, it is possible to easily remove the jammed sheet, from the above-mentioned space. Further, since the space is formed in the middle of the image forming system 51 in the horizontal direction, problems of the conventional art such as goods are placed thereon and a part of another device enters thereto rarely occur. For this reason, interferences of surrounding goods on the occasion of unjamming treatment are eliminated so that it becomes unnecessary to detach or reposition the post-treatment device 53 in order to make the space for the unjamming treatment. The outer shape of the image forming system 51 is unchanged on the occasion of the unjamming treatment.

As a result, in this image forming system 51, on the occasion of performing unjamming treatment between the image forming device 52 and the post-treatment device 53, it is unnecessary to carry out cumbersome operations to make a space between the image forming device 52 and the post-treatment device 53, and hence the recovery of the image forming system 51 can be easily conducted.

Figure 4:
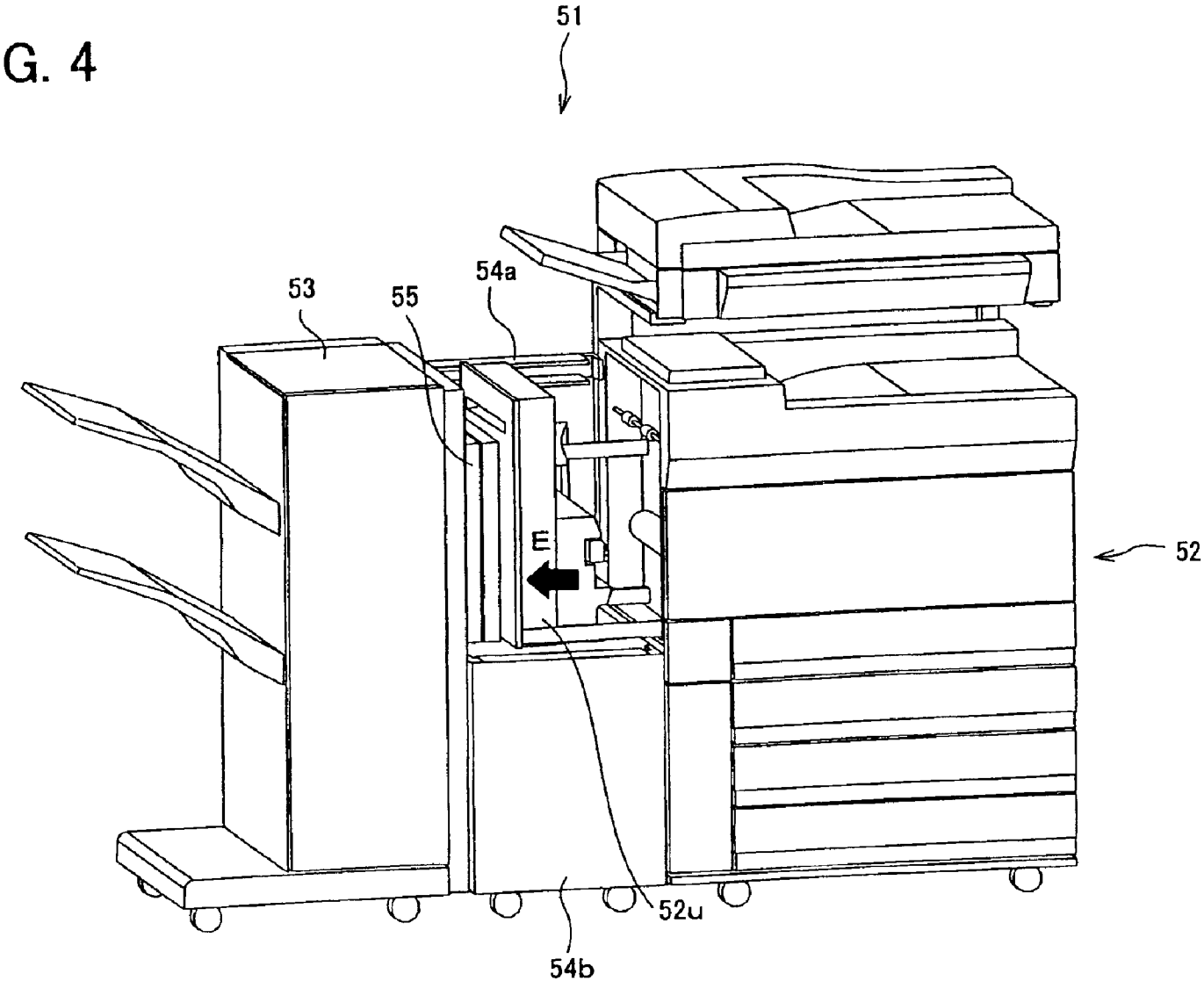
FIG. 4 is an oblique outline view, showing the operation subsequent to the operations in FIG. 3.

Now, an example of the operations on the occasion of unjamming treatment will be described with reference to FIGS. 3 and 4. Provided that paper jam occurs inside the image forming device 52, first, a message indicating the occurrence of the paper jam is displayed on a control panel (not illustrated) of the image forming device 52. Following the displayed instructions, the user tries to remove the jammed sheet from the above-mentioned space.

In the image forming system 51 in FIG. 3, the user releases the connection between the transfer relaying device 55 and the image forming device 52, and causes the transfer relaying device 55 to rotate from P to Q in the direction indicated by an arrow. Then the surface of the transfer relaying device 55 becomes, as illustrated in FIG. 4, in parallel with the side face of the post-treatment device 53. The width of the space for the unjamming treatment is shorter than the length L by the thickness of the transfer relaying device 55. To this space, a predetermined unit u in the image forming device 52 is pulled off in the direction of an arrow E, in order to release the carrying path inside the image forming device 52. In this state, the user removes the jammed sheet.

In this manner, on the occasion of the unjamming treatment, the connection between the image forming device 52 and the post-treatment device 53 by the transfer relaying device 55 is released and the transfer relaying device 55 is rotated downwards for 90°, so that the upper limit of the above-mentioned space, which has been limited by the transfer relaying device 55, is eliminated. Since the transfer relaying device 55 is shaped like a plate, the 90° rotation of the transfer relaying device 55 does not narrow the space to be insufficient for the unjamming treatment.

Thus, conventionally-required tiresome operations to detach or reposition the post-treatment device 53 are unnecessary. Note that, although the present embodiment is arranged such that the movable end of the transfer relaying device 55 moves from the image forming device 52 towards the post-treatment device 53, the present invention may be arranged in such a manner that the transfer relaying device 55 rotates towards the image forming device 52 to allow the user to open a door of the post-treatment device 53 or pull out a predetermined unit from the post-treatment device 53, on the occasion of unjamming treatment.

In this manner, since the transfer relaying device 55 is removed from the top of the space when performing the unjamming treatment, it is possible to perform the operations from the top of the space so that the space can be effectively used.

Further, in the image forming system 51, the transfer relaying device 55 may be provided so as to rotate towards the side opposite to the side of the control panel of the image forming system 51, i.e. rotate from the front side to the back side of the system 51. An example of unjamming treatment in this case will be described with reference to FIGS. 5 and 6.

Figure 5:
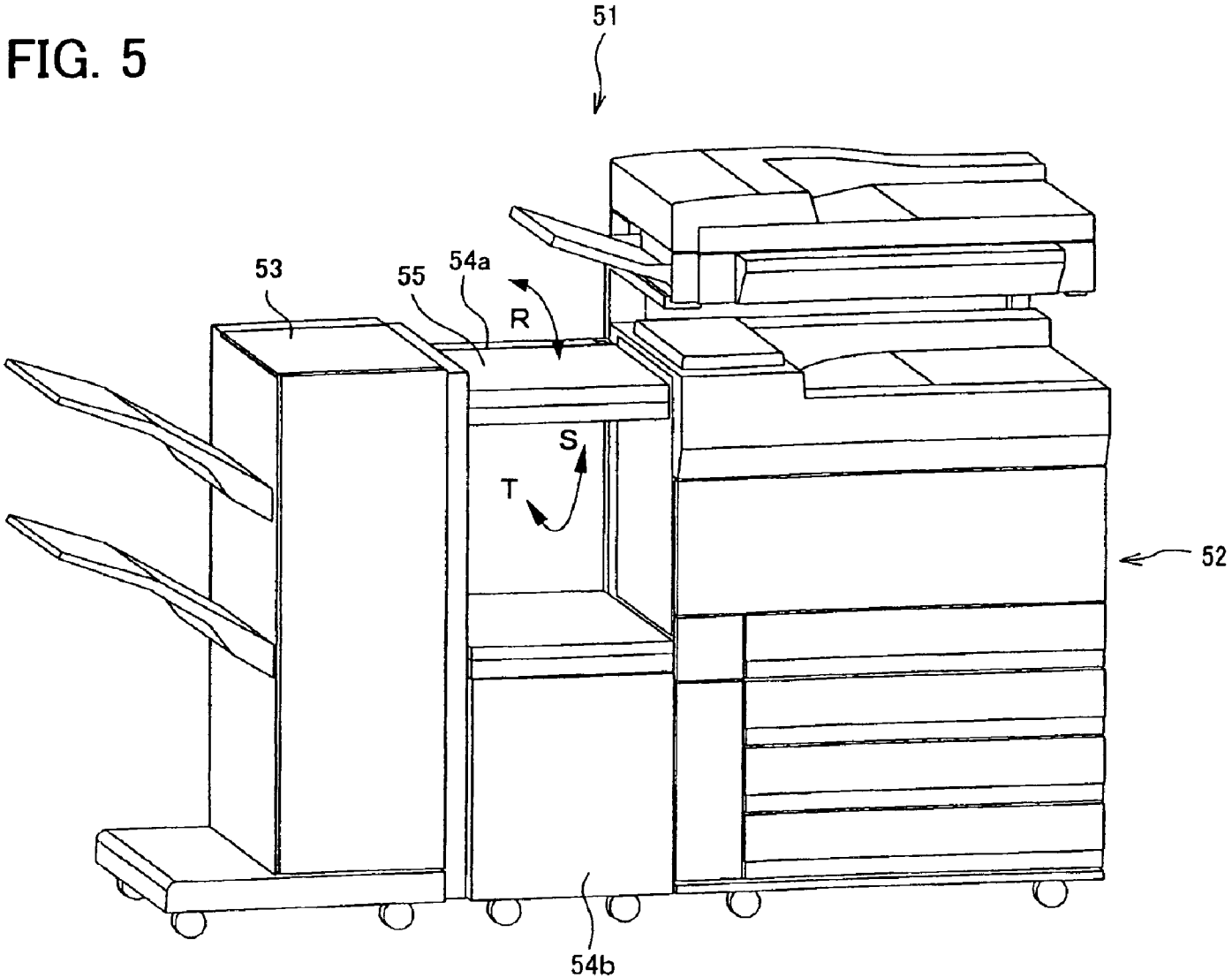
FIG. 5 is an oblique outline view, showing the operation of the transfer relaying device on the occasion of unjamming treatment of an alternatively-arranged image forming system of FIG. 1.
Figure 6:
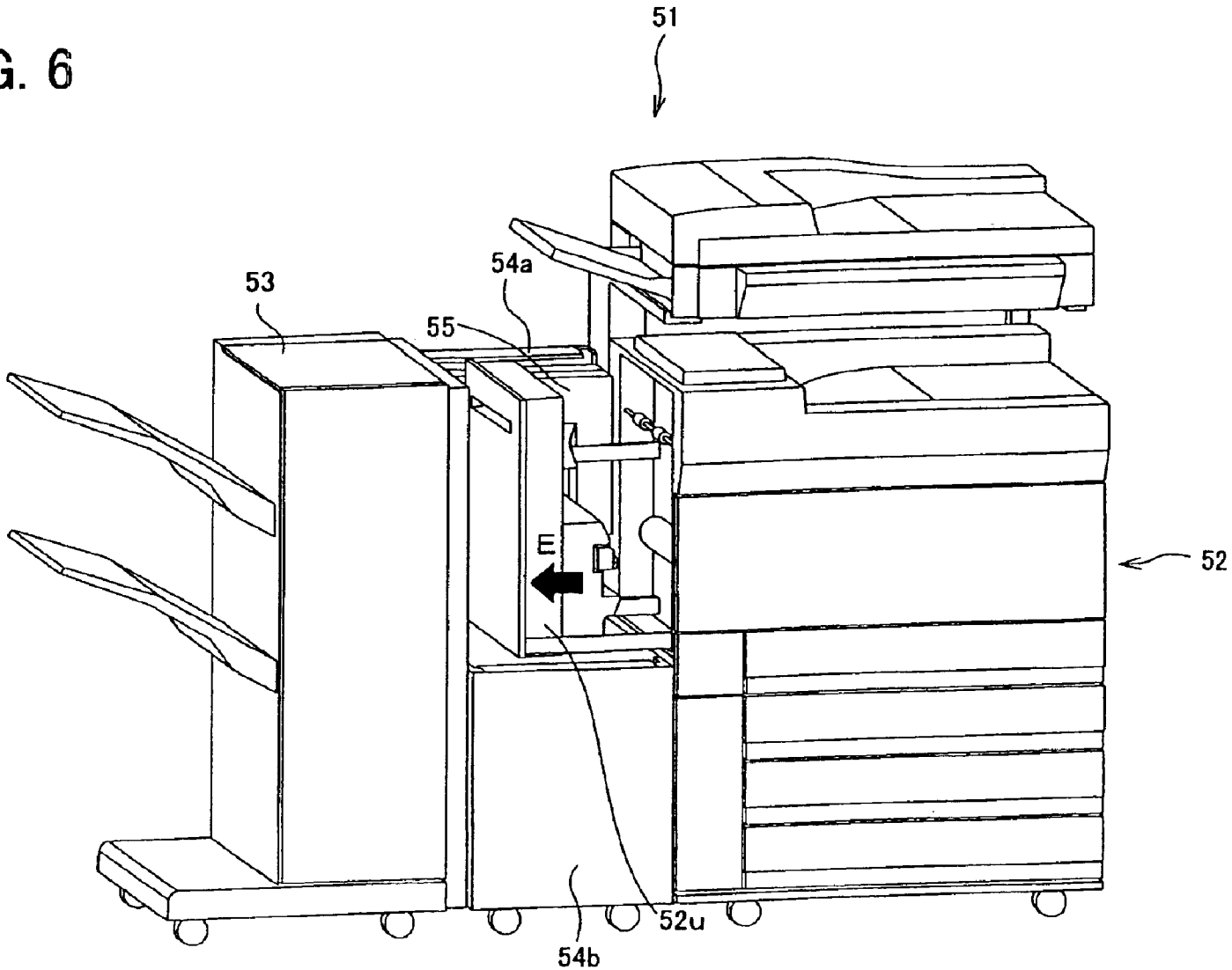
FIG. 6 is an oblique outline view, showing the operation subsequent to the operations in FIG. 5.

Provided that paper jam occurs in the image forming device 52, in the image forming system 51 of FIG. 5, the user releases the connection between the transfer relaying device 55 and the image forming device 52 and causes the transfer relaying device 55 to rotate in the direction from S to T as indicated by an arrow in the figure. This direction is perpendicular to the direction P-Q in FIG. 3. Then the transfer relaying device 55 becomes, as FIG. 6 shows, parallel to the surface of the upper connecting member 54*a* (and the back face of the image forming system 51). In this case, the width of the space for unjamming treatment is identical with the length L before the rotation. Subsequently, a predetermined unit u inside the image forming device 52 is pulled out to the space in the direction indicated by an arrow E, and a carrying path in the image forming device 52 is released. In this state, the user removes the jammed sheet.

Also in this arrangement, the transfer relaying device 55 is removed from the top of the space on the occasion of the unjamming treatment, so that the operations can be done from the top of the space. However, in this arrangement, since the transfer relaying device 55 rotates so as to be moved to the side opposite to the side from which the user of the image forming system 51 usually performs the unjamming treatment, it is possible to use the space more effectively.

Moreover, when the transfer relaying device 55 rotates for 90° towards either the image forming device 52 or the post-treatment device 53 as described above, the space is narrowed by the thickness of the rotated transfer relaying device 55. To equalize the horizontal length of the space between the image forming device 52 and the post-treatment device 53, which is narrowed as above, and the horizontal length of the space on the occasion of rotating the transfer relaying device 55 towards the side opposite to the side of the control panel of the image forming system 51, the length L between the image forming device 55 and the post-treatment device 53 has to be lengthened by the thickness of the transfer relaying device 55. Thus, the transfer relaying device 55 in the horizontal state has to be lengthened in the direction of connecting the image forming device 52 and the post-treatment device 53. On this account, when the transfer relaying device 55 is arranged so as to rotate towards the side opposite to the side from which unjamming treatment is performed, it is possible to reduce the horizontal length, i.e. width of the image forming system 51.

In the foregoing two examples, it is possible to pull the predetermined unit (predetermined part) 52*u* off to the space and release the sheet carrying path of the image forming device 52, after rotating the transfer relaying device 55. With this arrangement, it is possible to easily treat the jam occurring in the carrying path of the image forming device 52, using the space in a highly effective manner.

In the image forming system 51, the positioning member 54 is composed of the upper connecting member 54a which is provided on the side opposite to the side of the control panel of the image forming system 51 and the recording material feeding device 54*b* provided below the space. Thus, on the side of the control panel of the image forming system 51, the space is not obstructed by the positioning member 54, and hence, using the space, the user can easily perform the unjamming treatment from the side of the control panel of the image forming system 51.

Further, in the image forming system 51, the recording material feeding device 54*b* which is a device for performing a system-related process can be provided as the second positioning member. With this arrangement, it is possible to perform a system-related process, that is, feeding sheets from a device storing a large amount of sheets to the image forming device 52, by the second positioning member. Thus, since it is unnecessary to separately provide the recording material feeding device 54*b*, the overall size of the image forming system 51 can be reduced. Moreover, this arrangement makes it possible to increase the total amount of the sheets to be supplied to the image forming device 52. Since the present embodiment assumes a case that the space occupied by the second positioning member is large enough to accommodate a device for storing a vast amount of sheets, the above-mentioned arrangement makes it possible to do away with the operation to frequently supply the sheets.

The image forming system 1 has been described as above.

Note that, the image forming system 1 may be arranged in an alternative manner. Possible arrangements are as follows: the predetermined unit 52*u* of the image forming device 52 is pulled off to the space without rotating the transfer relaying device 55; on the occasion of unjamming treatment, a door of the image forming device 52 is opened from the space; and on the occasion of paper jam in the transfer relaying device 55, the top surface of the transfer relaying device 55 is opened upwards as indicated by an arrow R in FIG. 5, in order to remove the jammed sheet.

In the description of the image forming system 1, the post-treatment device 53 has been taken as an example of the peripheral unit. However, the peripheral unit may be any kind of device, on condition that the device is provided alongside of the image forming device 52 so as to be coupled therewith, can carry sheets on which images are formed from the image forming device 52, and can subject the sheets to predetermined treatments. The transfer relaying device 55 may be provided as a part of such a peripheral unit. Further, although the image forming device 52 in the foregoing description is provided with members such as the automatic document carrying device 52*a* and the image scanning device 52*b*, these members are not necessarily provided. The image forming device 52 has to include at least a device which includes a part for image forming and a sheet carrying path and is subjected to unjamming treatment when necessary, such as the image recording device 52*c*.

As described above, the image forming system of the present embodiment, which includes an image forming device which forms an image on a recording material and a peripheral unit which is provided alongside the image forming device so as to be coupled with the image forming device, the peripheral unit subjecting the recording material, to which image forming is carried out by the image forming device, to a predetermined treatment, comprises: positioning means which determines positioning of the image forming device and the peripheral unit; and a transfer relaying device which relays the recording material supplied from the image forming device to the peripheral unit, the positioning means determining the positioning so as to cause a distance between the image forming device and the peripheral unit to be sufficient for a space provided for unjamming treatment of the recording material carried out between the image forming device and the peripheral unit, and the transfer relaying device connecting the image forming device and the peripheral unit so as to keep the space intact, except a part of the space occupied by the transfer relaying device.

According to this arrangement, a space for unjamming treatment of the recording material is provided between the image forming device and the peripheral unit in advance, thanks to such an arrangement that the positioning of the image forming device and the peripheral unit is determined by the positioning means, and the image forming device and the peripheral unit are connected via the transfer relaying device. Thus, when the recording material is jammed in a recording material carrying system either in the image forming device or in the peripheral unit coupled with the image forming device so that unjamming treatment is performed between the image forming device and the peripheral unit, it is possible to easily remove the jammed recording material, using the above-mentioned space. On this account, it is unnecessary to remove or reposition the peripheral unit to make the above-mentioned space for the unjamming treatment.

As a result, it is possible to obtain an image forming system in which an image forming device is coupled with a peripheral unit, which does not require cumbersome operations to make a space between the image forming device and the peripheral unit, on the occasion of carrying out unjamming treatment between the image forming device and the peripheral unit. Note that, "a distance between the image forming device and the peripheral unit to be sufficient for a space provided for unjamming treatment" is a distance which allows the user to certainly perform the unjamming treatment. For instance, the distance is preferably not less than a half of the maximum allowable paper length for image forming.

Further, the image forming system of the present embodiment is preferably arranged in such a manner that, the transfer relaying device is a plate-shaped device which is horizontally provided and determines an upper limit of the space, and the transfer relaying device can rotate downwards for 90°, when a connection between the image forming device and the peripheral unit is released.

According to this arrangement, the connection between the image forming device and the peripheral unit by the transfer relaying device is released on the occasion of the unjamming treatment, and the transfer relaying device rotates downwards for 90° so that the transfer relaying device no longer restrict the upper limit of the space. Since the transfer relaying device is plate-shaped, the transfer relaying device after the rotation does not narrow the space to be insufficient for the unjamming treatment. Thus, cumbersome operations such as removing or repositioning the peripheral unit, which have conventionally been required, are unnecessary.

In this manner, since the transfer relaying device is moved from the upper limit of the space on the occasion of the unjamming treatment, the operations can be carried out from above, and hence it is possible to use the space with more efficiency.

Further, the image forming system of the present embodiment is preferably arranged in such a manner that, the transfer relaying device rotates towards a side of the image forming system, the side being opposite to a side on which a control panel of the image forming system is provided.

According to this arrangement, the transfer relaying device having been rotated is moved to the side opposite to the side of the control panel of the image forming device, i.e. to the side opposite to the side from which the unjamming treatment is usually carried out. For this reason, it is possible to use the space with more efficiency.

When the transfer relaying device is caused to rotate in the direction either towards the image forming device or towards the peripheral unit, the space is narrowed by the thickness of the moved transfer relaying device. To equalize the horizontal length of the space between the image forming device and the peripheral unit, which is narrowed as above, and the horizontal length of the space on the occasion of the unjamming treatment of the present invention, the length between the image forming device and the peripheral unit is lengthened by the thickness of the transfer relaying device. On this account, the length of the horizontally-provided transfer relaying device in the direction from the image forming device to the peripheral unit is lengthened. Thus, by causing the transfer relaying device to move towards the side opposite to the side from which the unjamming treatment is performed, it is possible to shorten the horizontal length of the image forming system in the direction of connecting the image forming device with the peripheral unit, i.e. it is possible to shorten the width of the image forming system.

Further, the image forming system of the present embodiment is preferably arranged in such a manner that, after the transfer relaying device rotates, a predetermined part of the image forming device is moved to the space so that a carrying path of the recording material, the carrying path being provided in the image forming device, can be released.

According to this arrangement, after the transfer relaying device rotates, the predetermined part of the image forming device is moved to the space so that the carrying path of the image forming device is released. Thus, it is possible to easily carry out the removal of the jammed sheet in the carrying path of the image forming device, using the space with high efficiency.

Further, the image forming system in accordance with the present embodiment is preferably arranged in such a manner that, the positioning means includes: a first positioning member which connects the image forming device with the peripheral unit, on a side being opposite to a side on which a control panel of the image forming system is provided; and a second positioning member which connects the image forming device with the peripheral unit, below the space.

According to this arrangement, the positioning means is composed only of the first positioning member provided on the side opposite to the control panel of the image firming system and the second positioning member provided below the space, and hence the positioning means is not provided on the side of the control panel of the image forming system. For this reason, via the above-mentioned space, it is possible to easily perform the unjamming treatment from the side of controlling the image forming system.

Further, the image forming system of the present embodiment is preferably arranged in such a manner that, as the second positioning member, a predetermined device performing a process related to the image forming system can be adopted.

According to this arrangement, the predetermined device performing a process related to the image forming system is adopted as the second positioning member so that the process can be performed by the second positioning member. Thus, since it is unnecessary to additionally provide the predetermined device, it is possible to reduce the overall size of the image forming system.

Further, the image forming system of the present embodiment is preferably arranged in such a manner that, the predetermined device is a recording material feeding device which stores the recording material supplied to the image forming device.

According to this arrangement, since the recording material feeding device is the predetermined device adopted as the second positioning member, it is possible to store a larger amount of the recording materials to be supplied to the image forming device. Moreover, if the second positioning member is large and occupies a large space, it is possible to store a large amount of recording materials in the recording material feeding device which is adopted as the second positioning member, and in this case the user do not have to frequently supply the recording materials.

Embodiment 2

The following will describe another embodiment of the present invention with reference to FIGS. 7–12. By the way, members having the same functions as those described in Embodiment 1 are given the same numbers, so that the descriptions are omitted for the sake of convenience.

Figure 7:
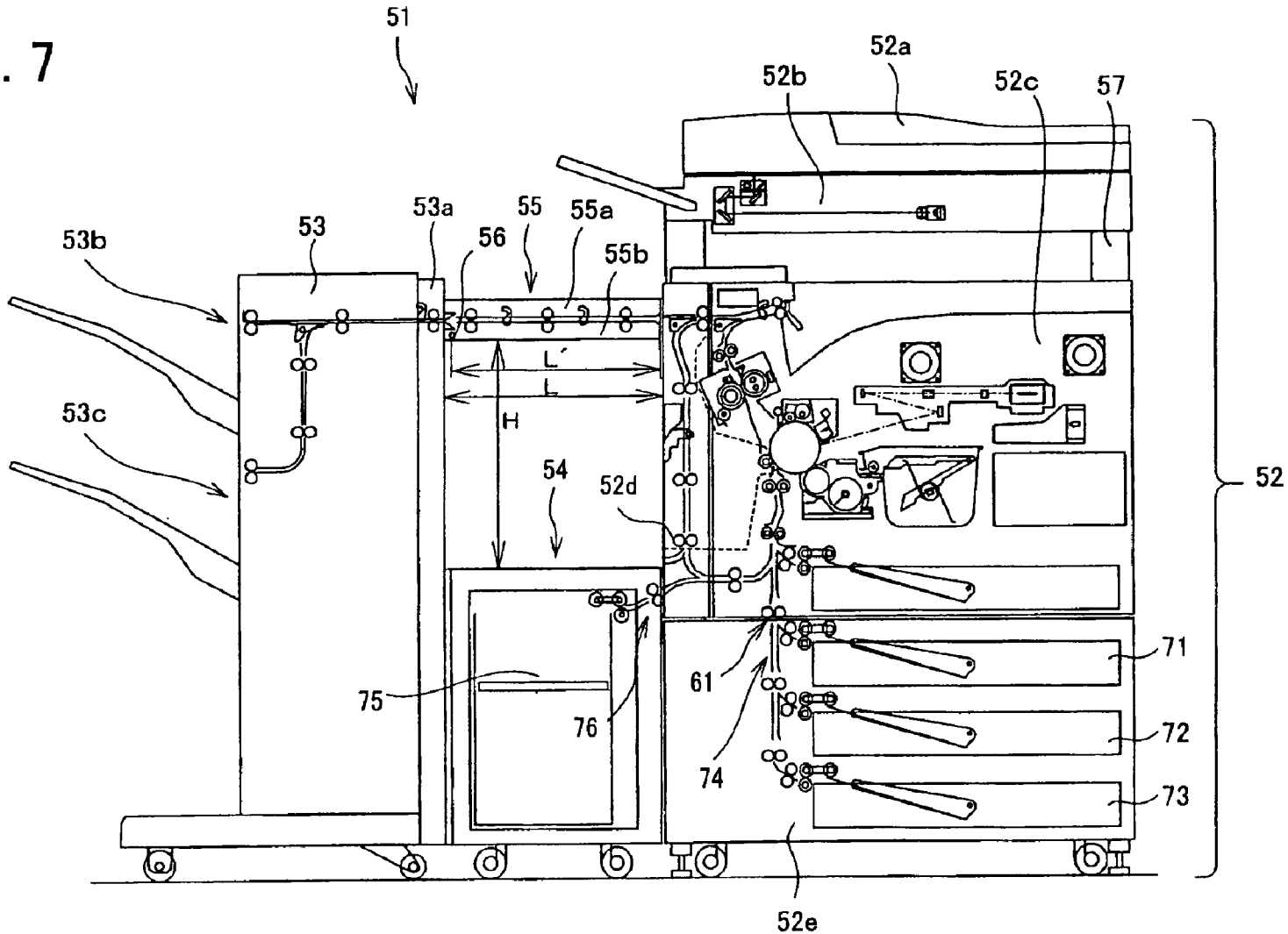
FIG. 7 is a cross section, illustrating an image forming system of another embodiment of the present invention.

FIG. 7 illustrates an image forming system 51 of the present embodiment. This image forming system 51 includes an image forming device 52, a post-treatment device 53, a positioning member 54, and a transfer relaying device 55.

The transfer relaying device 55 connects the image forming device 52 with the post-treatment device 53, and relays the supply of sheets from the image forming device 52 to the post-treatment device 53. The transfer relaying device 55 also acts as a first positioning means which determines the positioning of the image forming device 52 and the post-treatment device 53, in the upper part of the image forming system 51.

The positioning member (second positioning means) 54 determines the positioning of the image forming device 52 and the post-treatment device 53 in the lower part of the image forming system 51, and also acts as a fixing member for fixing the image forming member 52 and the post-treatment device 53 not to move during the operation of the image forming system 51. The positioning member 54 may be: an integral-type member; a structure composed of a front positioning member and a back positioning member which perform positioning in the front side and back side of the image forming system 51, respectively; or a structure composed of members such as the front and back positioning members and a stay for connecting these members.

The positioning member 54 is not necessarily provided sorely for determining the position of the image forming device 52 and the post-treatment device 53, and hence a device which can perform other functions may be adopted as the positioning member 54. In an example illustrated in FIG. 7, a recording material feeding device which can store a large amount of sheets and feeds sheets to the image recording device 52*c* is adopted as the positioning member 54. Hereinafter, in the present embodiment, the positioning member 54 is termed as a recording material feeding device 54.

The post-treatment device (peripheral unit) 53 is provided alongside the image forming device 52 so as to be coupled with the image forming device 52 via the recording material feeding device 54 and the transfer delaying device 55. When the post-treatment device 53 receives a sheet, on which an image is formed by the image forming device 52, via the transfer relaying device 55, the post-treatment device 53 subjects the sheet to predetermined post-treatments such as punch hole forming, stapling, and sorting.

As illustrated in FIG. 7, the recording material feeding device 54 is provided so as to occupy the lower part of a space between the image forming device 52 and the post-treatment device 53, and includes a recording material feeding section 75. This recording material feeding section 75 stores sheets, and on the occasion of conducting sheet supply, the recording material feeding section 75 supplies the stored sheets to a recording material discharging section 76 provided in the upper part of the right face of the recording material feeding device 54, in a separated manner. The recording material feeding device 54 can store sheets more than the sheets stored in recording material feeding sections 71–73 of the image recording device 52*c*. The operation to supply or replace sheets to/in the recording material feeding section 75 is carried out by pulling the recording material feeding section 75 off towards the front side of the main body of the recording material feeding device 54.

The bottom surface of the recording material feeding device 54 is flush with the bottom surface of the image forming device 52 and the bottom surface of the post-treatment device 53, while the top surface of the recording material feeding device 54 is restricted to allow a predetermined unit to be pulled off above the recording material feeding device 54, from the image forming device 52 towards the post-treatment device 53, on the occasion of unjamming treatment.

As described above, the recording material feeding device 54 acts as the second positioning means so as to determine the position of the image forming device 52 and the post-treatment device 53. The recording material feeding device 54 is provided between the image forming device 52 and the post-treatment device 53 and fixed to these devices. Thus, the image forming device 52 is connected to the post-treatment device 53.

As illustrated in FIG. 7, the transfer relaying device 55 is a horizontally-provided and plate-shaped device which connects the top part of the recording material re-feeding/carrying device 52*d* with the top part of the post-treatment device 53. In this state, the transfer relaying device 55 receives the sheet, on which the image forming by the image recording device 52*c* is finished, from the recording material re-feeding/carrying device 52*d*, and supplies the sheet to the post-treatment device 53.

The transfer relaying device 55 is composed of a top-surface section 55*a* and a bottom-surface section 55*b* bordering each other at a sheet relaying path, and the top-surface section 55*a* of the transfer relaying device 55 has a positioning/connection function for connecting the image forming device 52 (including the recording material re-feeding/carrying device 52*d*) with the post-treatment device 53. In contrast, the bottom-surface section 55*b* of the transfer relaying device 55 is provided so as to be rotatable around a rotation axis 56 attached to the transfer relaying device 55, so that the bottom-surface section 55*b* can rotate on occasions when removing a sheet jammed in the relaying path or releasing the image forming section or the re-feeding path.

Being connected by the recording material feeding device 54 and the transfer relaying device 55, the image forming device 52 and the post-treatment device 53 are positioned to keep a horizontal distance L (cf. FIG. 7) to obtain a space sufficient for unjamming treatment performed therebetween, i.e. the devices 52 and 53 are positioned to keep the distance L in order to allow the predetermined unit to be pulled off to the extent of sufficiently performing unjamming treatment.

The rotation axis 56 of the transfer relaying device 55 is provided along the direction of connecting the front side and back side of the image forming system 51, and as in FIG. 7, a horizontal distance from the junction of the transfer relaying device 55 and the recording material re-feeding/carrying device 52*d* to the rotation axis 56 is kept at a length L'. When the connection between the bottom-surface section 55*b* and the recording material re-feeding/carrying device 52*d* is released so that the carrying path is detached from the image forming device 52, the bottom-surface section 55*b* of the transfer relaying device 55 is allowed to rotate downward for 90° around the rotation axis 56. Since L'<L, the bottom-surface section 55*b* after the rotation becomes substantially parallel to the side face of the post-treatment device 53.

Also, the transfer relaying device 55 is provided above the top surface of the recording material feeding device 54, and the distance between these devices is kept at a length H as in FIG. 7. Thus, the connection between the transfer relaying device 55 and the recording material re-feeding/carrying device 52*d* is done in consideration of keeping the space having the distance L for unjamming treatment intact, except a part of the space occupied by the bottom-surface section 55*b* of the transfer relaying device 55. On this account, the space for sufficiently performing unjamming treatment remains between the image forming device 52 and the post-treatment device 53, even if the bottom-surface section 55*b* is provided. Hence, even if the remaining space is not sufficient for unjamming treatment when the transfer relaying device 55 is connected as above, it is possible to enlarge the space so as to suffice for the unjamming treatment, by appropriately moving the bottom-surface section 55*b* between the image forming device 52 and the post-treatment device 53. To allow the foregoing rotation, it is determined that H>L. In this manner, being surrounded by the image forming device 52, the post-treatment device 53, the recording material feeding device 54, and the transfer relaying device 55, the space whose opening has the size of H×L is formed in the image forming system 51 as FIG. 7 illustrates.

Now, an example of the operations on the occasion of unjamming treatment will be described with reference to FIGS. 8 and 9. Provided that paper jam occurs inside the image forming device 52, first, a message indicating the occurrence of the paper jam is displayed on a control panel (not illustrated) of the image forming device 52. Following the displayed instructions, the user tries to remove the jammed sheet from the above-mentioned space.

Figure 8:
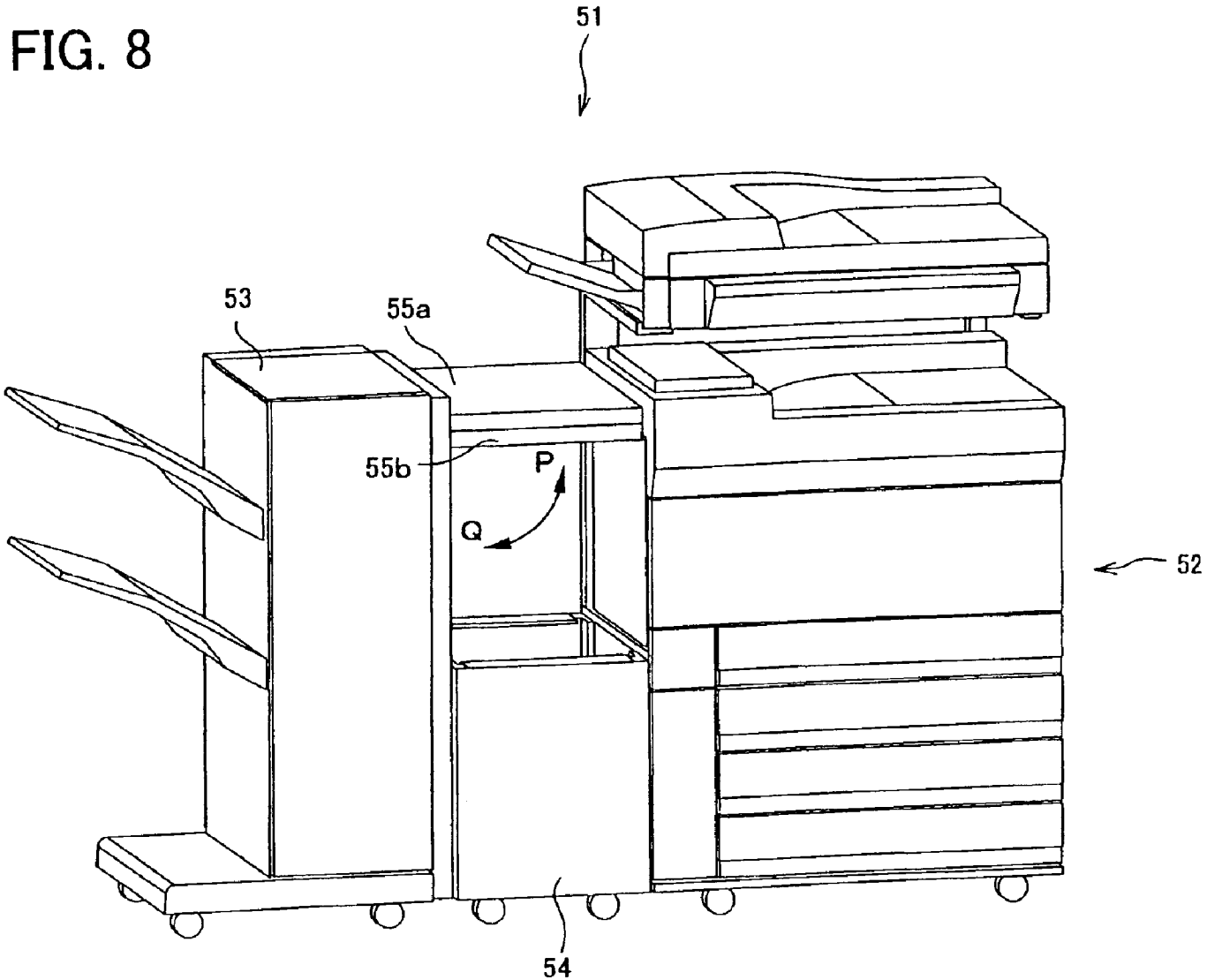
FIG. 8 is an oblique outline view, showing the operation of a transfer relaying device on the occasion of unjamming treatment of the image forming system of FIG. 7.

In the image forming system 51 in FIG. 8, the user releases the connection between the bottom-surface section 55*b* of the transfer relaying device 55 and the image forming device 52, and causes the bottom-surface section 55*b* to rotate from P to Q in the direction indicated by an arrow. Then the surface of the bottom-surface section 55*b* becomes, as illustrated in FIG. 9, in parallel with the side face of the. post-treatment device 53. The width of the space for the unjamming treatment is shorter than the length L by the thickness of the bottom-surface section 55*b*. To this space, a predetermined unit 52*u* in the image forming device 52 is pulled off in the direction of an arrow E, in order to release the carrying path inside the image forming device 52. In this state, the user removes the jammed sheet.

In this manner on the occasion of the unjamming treatment, the connection between the image forming device 52 and the post-treatment device 53 by the bottom-surface section 55*b* of the transfer relaying device 55 is released and the bottom-surface section 55*b* is caused to rotate downwards for 90°, so that the bottom-surface section 55*b* is moved from the upper limit of the above-mentioned space. Since the bottom-surface section 55*b* is shaped like a plate, the 90° rotation of the transfer relaying device 55 does not narrow the space to be insufficient for the unjamming treatment.

Thus, conventionally-required tiresome operations to detach or reposition the post-treatment device 53 are unnecessary. Note that, although the present embodiment is arranged such that the movable end of the bottom-surface section 55*b* of the transfer relaying device 55 moves from the image forming device 52 towards the post-treatment device 53, the present invention may be arranged in such a manner that the bottom-surface section 55*b* rotates towards the image forming device 52 to allow the user to open a door of the post-treatment device 53 or pull out a predetermined unit from the post-treatment device 53, on the occasion of unjamming treatment.

Further, in the case of the above-described unjamming treatment, only the bottom-surface section 55*b* of the transfer relaying device 55 rotates and the top-surface section 55*a* remains unmoved, the relaying path inside the transfer relaying device 55 is also released by the rotation of the bottom-surface section 55*b*. Thus, when a sheet is jammed at the junction between the image forming device 52 and the transfer relaying device 55, it is possible to easily perform unjamming treatment by releasing the relaying path, and also the rotation of the bottom-surface section 55*b* can be performed without the interference of the sheet.

Moreover, even if an object is placed on the top-surface of the top-surface section 55*a* of the transfer relaying device 55, the top-surface section 55*a* does not rotate on the occasion of unjamming treatment so that the unjamming treatment can be performed without removing the object on the top surface of the top-surface section 55*a*.

In the image forming system 51, the bottom-surface section 55*a* of the transfer relaying device 55 may be provided so as to rotate in the direction towards the side opposite to the side of the control panel of the image forming system 51, i.e. in the direction from the front side to the back side of the system. An example of operations of unjamming treatment in this case will be described with reference to FIGS. 10–12.

Figure 9:
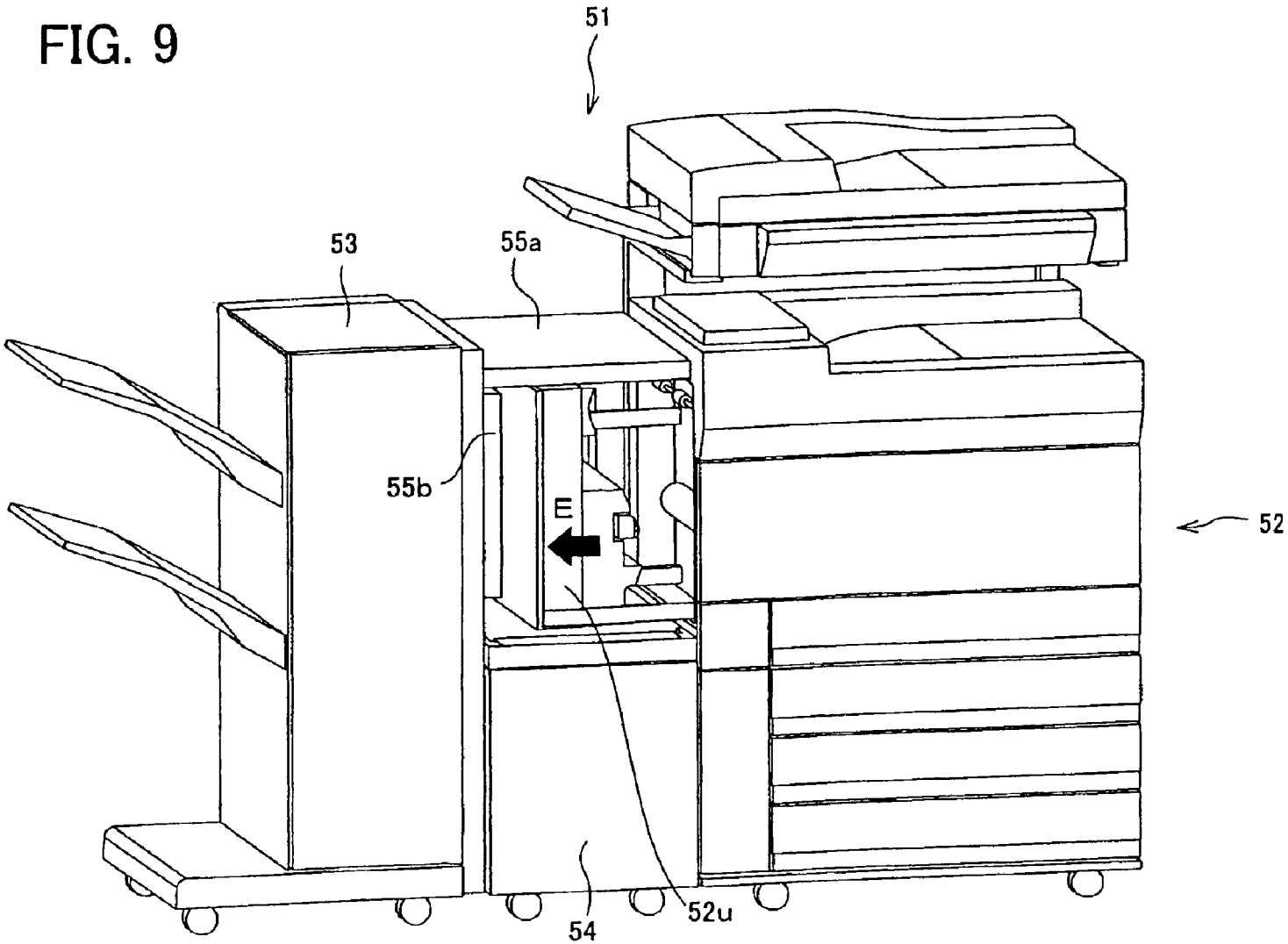
FIG. 9 is an oblique outline view, showing the operation subsequent to the operations in FIG. 7.
Figure 10:
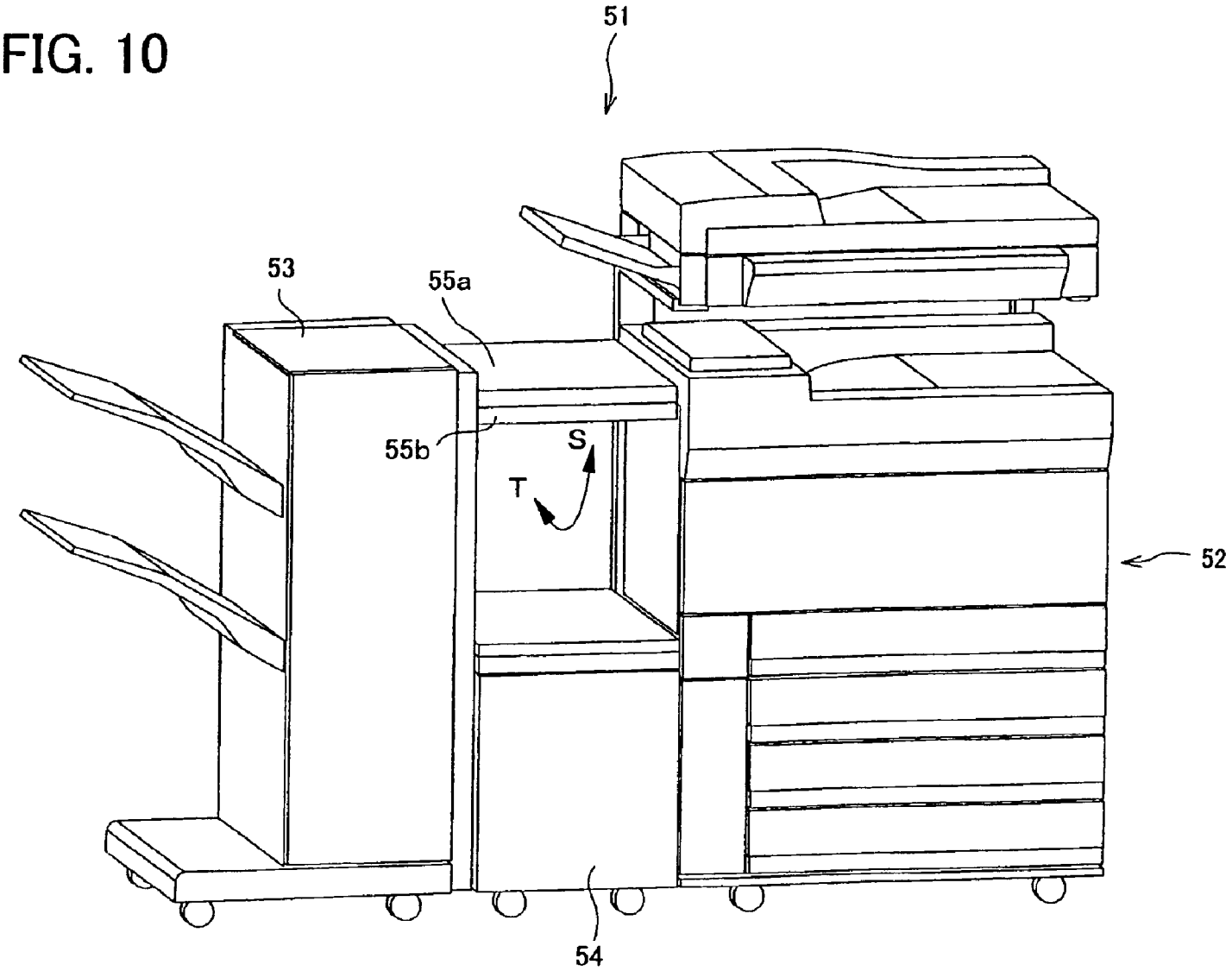
FIG. 10 is an oblique outline view, showing the operation of a transfer relaying device on the occasion of unjamming treatment of an alternatively-arranged image forming system of FIG. 7.
Figure 11:
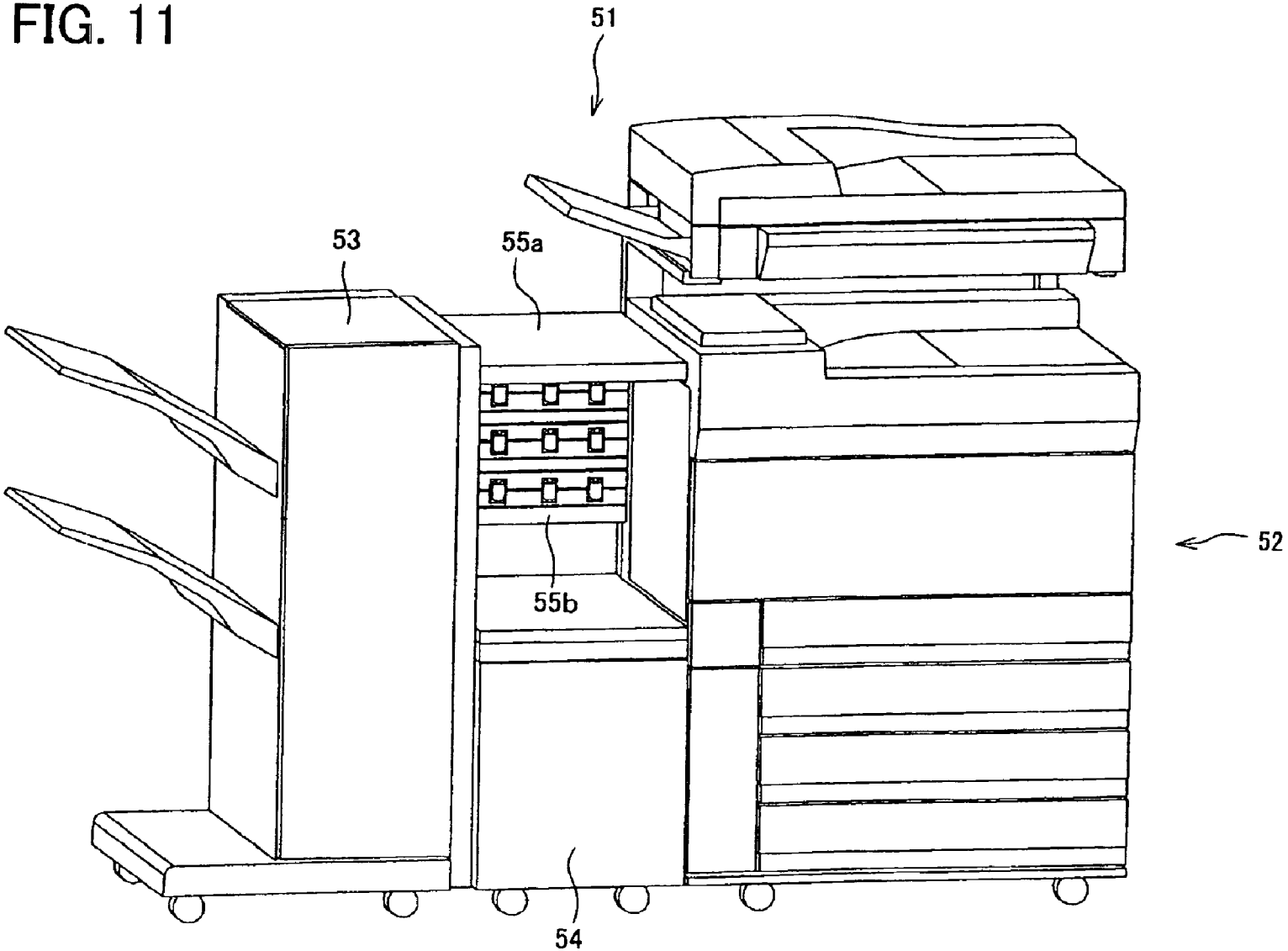
FIG. 11 is an oblique outline view, showing the operation subsequent to the operations in FIG. 10.
Figure 12:
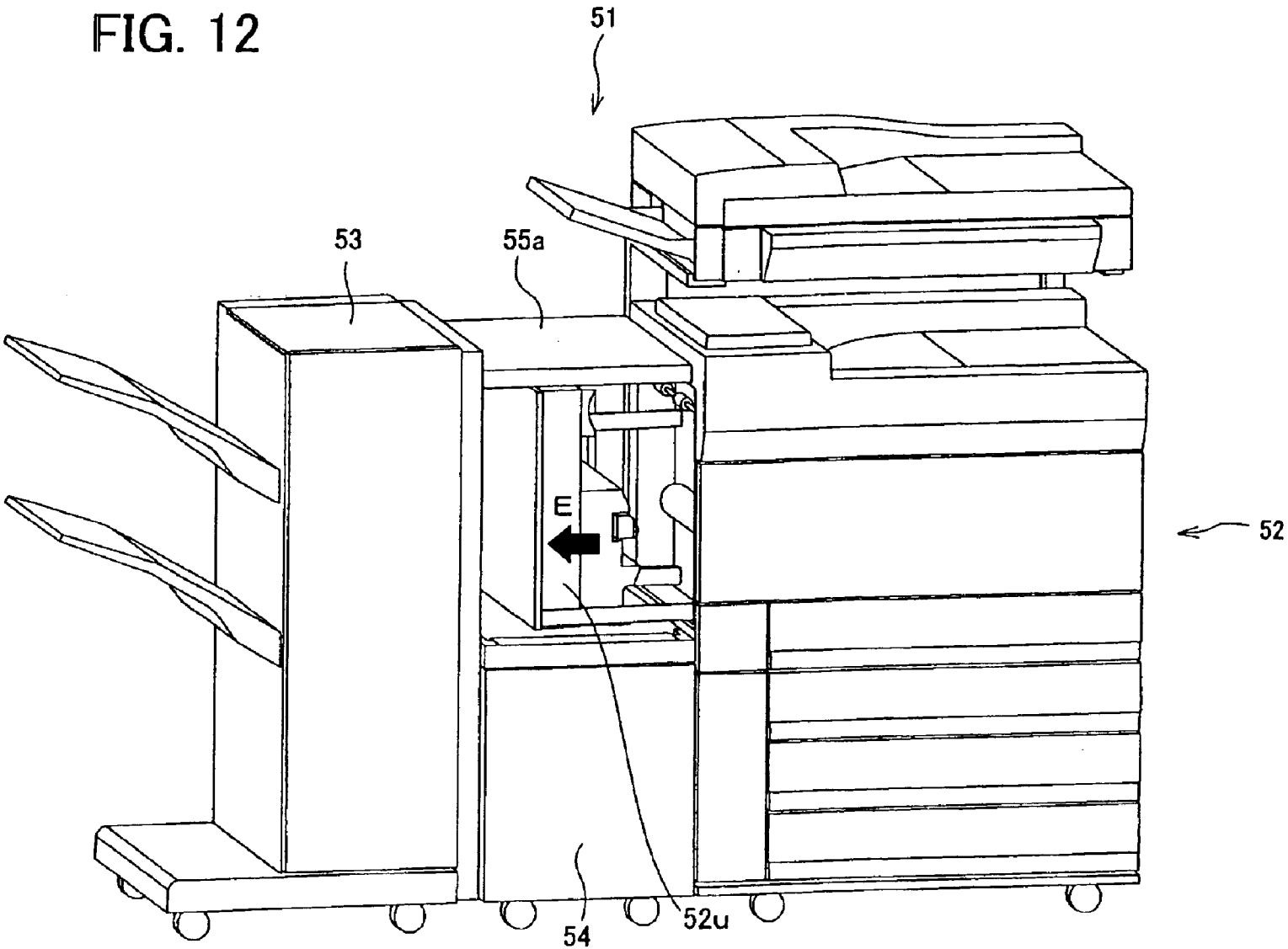
FIG. 12 is an oblique outline view, showing the operation subsequent to the operations in FIG. 11.

Provided that paper jam occurs in the image forming device 52 of the image forming system 51 shown in FIG. 10, the connection between the transfer relaying device 55 and the image forming device 52 by the bottom-surface section 55*b* is released by the user, and the user causes the bottom-surface section 55*b* to rotate from S to T in the direction indicated by an arrow. This direction is orthogonal to the direction from P to Q in FIG. 9. Then as illustrated in FIG. 11, the bottom-surface section 55*b* becomes in parallel with the back side of the image forming system 51. The width of the resultant space for unjamming treatment is identical with the length L and hence remains unchanged. Subsequently, as FIG. 12 shows, a predetermined unit 52*u* in the image forming device 52 is pulled off towards the space in the direction of an arrow E so that the carrying path inside the image forming device 52 is released. In this state, the user removes the jammed sheet.

Also in the example illustrated in FIGS. 10–12, the transfer relaying device 55 is moved from the top of the space on the occasion of unjamming treatment so that the operations concerning the unjamming treatment can be performed from above, as in the case of the example illustrated in FIGS. 8 and 9. However, in the present example, since the bottom-surface section 55*b* is moved to the side opposite to the side of the image forming system 51 from which side the user usually carries out the unjamming treatment, it is possible to use the space more effectively.

When the bottom-surface section 55*b* is caused to rotate for 90° towards either the image forming device 52 or the post-treatment device 53 as described above, the space is narrowed by the thickness of the rotated bottom-surface section 55*b*. Thus, to equalize the horizontal length of this narrowed space between the image forming device 55 and the post-treatment device 53 and the horizontal length of the space on the occasion of rotating the bottom-surface section 55*b* towards the side opposite to the side of the control panel of the image forming system 51, the length L between the image forming device 55 and the post-treatment device 53 has to be lengthened by the thickness of the bottom-surface section 55*b*. Thus, the transfer relaying device 55 in the horizontal state has to be lengthened in the direction of connecting the image forming device 52 with the post-treatment device 53. On this account, when the bottom-surface section 55*b* is arranged so as to rotate towards the side opposite to the side from which unjamming treatment is performed, it is possible to reduce the horizontal length, i.e. width of the image forming system 51.

In the foregoing two examples, it is possible to pull the predetermined unit (predetermined part) 52*u* off to the space and release the sheet carrying path of the image forming device 52, after rotating the bottom-surface section 55*b*. With this arrangement, it is possible to easily treat the jam occurring in the carrying path of the image forming device 52, using the space in a highly effective manner.

In the image forming system 51, the positioning member is only composed of the transfer relaying device 55 provided above the space and the recording material feeding device 54 provided below the space. Thus, on the side of the control panel of the image forming system 51, the space is not obstructed by the positioning member, and hence, using the space, the user can easily perform the unjamming treatment from the side of the control panel of the image forming system 51.

The image forming system 51 may be alternatively arranged such that, for instance, a door of the image forming device 52 is opened towards the space, on the occasion of unjamming treatment.

As described above, the image forming system of the present embodiment, which includes an image forming device which forms an image on a recording material and a peripheral unit which is provided alongside the image forming device so as to be coupled with the image forming device, the peripheral unit subjecting the recording material, to which image forming is carried out by the image forming device, to a predetermined treatment, comprises a transfer relaying device which acts as first positioning means which determines positioning of the image forming device and the peripheral unit in an upper part of the image forming system, and relays the recording material supplied from the image forming device to the peripheral unit; and second positioning means which determines positioning of the image forming device and the peripheral unit in a lower part of the image forming system, the first and second positioning means being provided so as to make a space therebetween, the space being for unjamming treatment of the recording material carried out between the image forming device and the peripheral unit, and the first and second positioning means causing a distance between the image forming device and the peripheral unit to be sufficient for the space, and the transfer relaying device being a plate-shaped device in which a relaying path is horizontally provided, a bottom-surface section provided below the relaying path being movable towards the space.

According to this arrangement, a space for unjamming treatment of the recording material is provided between the image forming device and the peripheral unit in advance, thanks to such an arrangement that the positioning of the image forming device and the peripheral unit is determined by the first positioning means (i.e. transfer relaying device) and the second positioning means, and the image forming device and the peripheral unit are connected via the transfer relaying device. Thus, when the recording material is jammed in a recording material carrying system either in the image forming device or in the peripheral unit coupled with the image forming device so that unjamming treatment is performed between the image forming device and the peripheral unit, it is possible to easily remove the jammed recording material, using the above-mentioned space. On this account, it is unnecessary to remove or reposition the peripheral unit to make the above-mentioned space for the unjamming treatment.

As a result, it is possible to obtain an image forming system in which an image forming device is coupled with a peripheral unit, which does not require cumbersome operations to make a space between the image forming device and the peripheral unit, on the occasion of carrying out unjamming treatment between the image forming device and the peripheral unit.

Further, when the unjamming treatment is performed using the above-described space, a predetermined unit for unjamming treatment, the unit being provided either in the image forming device or in the peripheral unit, is pulled off to the space so that a carrying path in which the jam occurs is released. On this occasion, since the bottom surface of the transfer relaying device can be opened towards the space, i.e. can be opened downwards, it is possible to easily perform the unjamming treatment by releasing the transfer relaying path, even if the jammed sheet is inside the transfer relaying path.

Moreover, even if an object is placed on the top-surface of a top-surface section of the transfer relaying device, it is unnecessary to cause the top-surface section to rotate on the occasion of unjamming treatment so that the unjamming treatment can be performed without removing the object on the top surface of the top-surface section.

Further, in the foregoing image forming system, the bottom-surface section of the transfer relaying device can rotate downwards for 90°, when a connection between the image forming device and the peripheral unit is released.

According to this arrangement, on the occasion of the unjamming treatment, the connection between the image forming device and the post-treatment device by the bottom-surface section of the transfer relaying device is released and the bottom-surface section is caused to rotate downwards for 90°, so that the bottom-surface section is moved from the upper limit of the above-mentioned space. Since the bottom-surface section is shaped like a plate, the 90° rotation of the transfer relaying device does not narrow the space to be insufficient for the unjamming treatment. For this reason, the bottom-surface section can be opened widely and the space after the rotation can be used more efficiently.

Further, in the foregoing image forming system, after the bottom-surface section of the transfer relaying device rotates, a predetermined part of the image forming device is moved to the space so that a carrying path of the recording material, the carrying path being provided in the image forming device, can be released.

According to this arrangement, the predetermined part of the image forming device is moved to the space after rotating the transfer relaying device so that the carrying path of the recording material is released. With this arrangement, it is possible to easily treat the paper jam occurring in the carrying path of the image forming device, from the space which is highly effective.

Further, in the foregoing image forming system, as the second positioning means, a predetermined device performing a process related to the image forming system can be adopted.

According to this arrangement, the predetermined device performing the process related to the image forming system is adopted as the second positioning means so that the process can be performed by the second positioning means. Thus, since it is unnecessary to additionally provide the predetermined device, it is possible to reduce the overall size of the image forming system.

Further, in the foregoing image forming system, the predetermined device is a recording material feeding device which stores the recording material supplied to the image forming device.

According to this arrangement, since the recording material feeding device is the predetermined device adopted as the second positioning member, it is possible to store a larger amount of the recording materials to be supplied to the image forming device. Moreover, if the second positioning member is large and occupies a large space, it is possible to store a large amount of recording materials in the recording material feeding device which is adopted as the second positioning member, and in this case the user do not have to frequently supply the recording materials.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. An image forming system, comprising:

an image forming device which forms an image on a recording material;

a peripheral unit which is provided alongside the image forming device so as to be coupled with the image forming device, the peripheral unit subjecting the recording material, to which image forming is carried out by the image forming device, to a predetermined treatment;

positioning means which determines positioning of the image forming device and the peripheral unit; and a transfer relaying device which relays the recording material supplied from the image forming device to the peripheral unit, the positioning means determining the positioning so as to cause a distance between the image forming device and the peripheral unit to be sufficient for a space provided for unjamming treatment of the recording material carried out between the image forming device and the peripheral unit, and the transfer relaying device connecting the image forming device and the peripheral unit so as to keep the space intact, except a part of the space occupied by the transfer relaying device.

2. The image forming system as defined in claim 1, wherein, the transfer relaying device is a plate-shaped device which is horizontally provided and determines an upper limit of the space, and the transfer relaying device can rotate downwards for 90°, when a connection between the image forming device and the peripheral unit is released.

3. The image forming system as defined in claim 1, wherein, the transfer relaying device is a plate-shaped device which is horizontally provided and determines an upper limit of the space, and the transfer relaying device can rotate upwards for 90°, when a connection between the image forming device and the peripheral unit is released.

4. The image forming system as defined in claim 2, wherein, the transfer relaying device rotates towards a side of the image forming system, the side being opposite to a side on which a control panel of the image forming system is provided.

5. The image forming system as defined in claim 2, wherein, the transfer relaying device rotates in a direction orthogonal to a direction of supplying the recording material from the image forming device to the peripheral unit.

6. The image forming system as defined in claim 2, wherein, after the transfer relaying device rotates, a predetermined part of the image forming device is moved to the space so that a carrying path of the recording material, the carrying path being provided in the image forming device, can be released.

7. The image forming system as defined in claim 1, wherein, the positioning means includes: a first positioning member which connects the image forming device with the peripheral unit, on a side being opposite to a side on which a control panel of the image forming system is provided; and a second positioning member which connects the image forming device with the peripheral unit, below the space.

8. The image forming system as defined in claim 7, wherein, as the second positioning member, a predetermined device performing a process related to the image forming system can be adopted.

9. The image forming system as defined in claim 8, wherein, the predetermined device is a recording material feeding device which stores the recording material supplied to the image forming device.

10. An image forming system, comprising:

an image forming device which forms an image on a recording material;

a peripheral unit which is provided alongside the image forming device so as to be coupled with the image forming device, the peripheral unit subjecting the recording material, to which image forming is carried out by the image forming device, to a predetermined treatment;

a transfer relaying device which acts as first positioning means which determines positioning of the image forming device and the peripheral unit in an upper part of the image forming system, and relays the recording material supplied from the image forming device to the peripheral unit; and second positioning means which determines positioning of the image forming device and the peripheral unit in a lower part of the image forming system, the first and second positioning means being provided so as to make a space therebetween, the space being for unjamming treatment of the recording material carried out between the image forming device and the peripheral unit, and the first and second positioning means causing a distance between the image forming device and the peripheral unit to be sufficient for the space, and the transfer relaying device being a plate-shaped device in which a relaying path is horizontally provided, a bottom-surface section provided below the relaying path being movable towards the space.

11. The image forming system as defined in claim 10, wherein, the bottom-surface section of the transfer relaying device can rotate downwards for 90°, when a connection between the image forming device and the peripheral unit is released.

12. The image forming system as defined in claim 10, wherein, the bottom-surface section of the transfer relaying device can rotate upwards for 90°, when a connection between the image forming device and the peripheral unit is released.

13. The image forming system as defined in claim 10, wherein, after the bottom-surface section of the transfer relaying device rotates, a predetermined part of the image forming device is moved to the space so that a carrying path of the recording material, the carrying path being provided in the image forming device, can be released.

14. The image forming system as defined in claim 10, wherein, as the second positioning means, a predetermined device performing a process related to the image forming system can be adopted.

15. The image forming system as defined in claim 14, wherein, the predetermined device is a recording material feeding device which stores the recording material supplied to the image forming device.

16. An image forming system, comprising:

an image forming device which forms an image on a recording material;

a peripheral unit which is provided alongside the image forming device so as to be coupled with the image forming device, the peripheral unit subjecting the recording material, to which image forming is carried out by the image forming device, to a predetermined treatment;

a transfer relaying device which acts as a first positioning member which determines positioning of the image forming device and the peripheral unit in an upper part of the image forming system, and relays supply of the recording material from the image forming device to the peripheral unit; and a second positioning member which determines positioning of the image forming device and the peripheral unit in a lower part of the image forming system, the first and second positioning members being provided so as to make a space therebetween, the space being for unjamming treatment of the recording material carried out between the image forming device and the peripheral unit, and the first and second positioning members causing a distance between the image forming device and the peripheral unit to be sufficient for the space, and the transfer relaying device being a plate-shaped device in which a relaying path is horizontally provided, a bottom-surface section provided below the relaying path being movable towards the space.

* * * * *